US006958581B2

(12) United States Patent
Okawa et al.

(10) Patent No.: US 6,958,581 B2
(45) Date of Patent: Oct. 25, 2005

(54) HIGH-INTENSITY DISCHARGE LAMP OPERATING DEVICE AND METHOD FOR CONTROLLING THE HIGH-INTENSITY DISCHARGE LAMP

(75) Inventors: Masanao Okawa, Woburn, MA (US); Hiroyasu Eriguchi, Lexington, MA (US)

(73) Assignee: Matsushita Electric Works, Ltd., Osaka (JP)

( * ) Notice: Subject to any disclaimer, the term of this patent is extended or adjusted under 35 U.S.C. 154(b) by 39 days.

(21) Appl. No.: 10/792,839

(22) Filed: Mar. 5, 2004

(65) Prior Publication Data

US 2005/0194916 A1 Sep. 8, 2005

(51) Int. Cl.[7] ..... H05B 37/02
(52) U.S. Cl. ..... 315/291; 315/307
(58) Field of Search ..... 315/291, 293, 315/295, 300, 307, 308, 320, 360, 209 R, 315/DIG. 5; H05B 37/02

(56) References Cited

U.S. PATENT DOCUMENTS 5,677,602 A * 10/1997 Paul et al. ..... 315/224
6,518,712 B2 * 2/2003 Weng ..... 315/209 R
6,583,570 B1 * 6/2003 Ito et al. ..... 315/82
6,583,587 B2 * 6/2003 Ito et al. ..... 315/308
2004/0251849 A1 * 12/2004 Harada et al. ..... 315/209 R
2004/0251852 A1 * 12/2004 Kambara et al. ..... 315/291

FOREIGN PATENT DOCUMENTS

| | | |
|---|---|---|
| JP | 2001-210485 | 8/2001 |
| JP | 2001-210490 | 8/2001 |
| JP | 2001-230089 | 8/2001 |
| JP | 2003-229289 | 8/2003 |

* cited by examiner

*Primary Examiner*—Trinh Vo Dinh
(74) *Attorney, Agent, or Firm*—Oblon, Spivak, McClelland, Maier & Neustadt, P.C.

(57) ABSTRACT

A high-intensity discharge lamp operating device includes a power supplier configured to supply power to a high-intensity discharge lamp, a memory containing a starter power data set, an identifying power data set and steady power data sets, a detector configured to detect voltage applied to the high-intensity discharge lamp, a power supplier controller configured to control the power supplier to control the power according to the starter power data set, the identifying power data set and one of the steady power data sets, a lamp power identifier configured to identify a lamp power of the high-intensity discharge lamp while the power supplier controller controls the power according to the identifying power data set after the starter power data set, and a data set selection unit configured to select one steady power data set based on the identified lamp power, and the power supplier controller is configured to control the power according to the steady power data set.

23 Claims, 22 Drawing Sheets

HIGH-INTENSITY DISCHARGE LAMP OPERATING DEVICE AND METHOD FOR CONTROLLING THE HIGH-INTENSITY DISCHARGE LAMP

BACKGROUND OF THE INVENTION

1. Field of the Invention

The present invention relates to a high-intensity discharge lamp operating device, a controlling device for a high-intensity discharge lamp, and a method for controlling a high-intensity discharge lamp.

2. Discussion of the Background

Japanese Unexamined Patent Publication No. TOKUKAI 2001-210485 discloses a discharge lamp lighting device including a lamp determination circuit which determines the lamp power of the discharge lamp connected to the lighting device. The lamp determination circuit performs such a determination based on the power supplied to the discharge lamp after the voltage applied to the discharge lamp becomes stable at a constant value, or at the initial stage of the lighting operation.

Japanese Unexamined Patent Publication No. TOKUKAI 2001-210490 discloses a discharge lamp lighting device including a lamp specifying circuit which specifies the type of the discharge lamp connected to the lighting device. The lamp specifying circuit specifies the lamp type based on the lamp current, lamp voltage or other characteristics of the discharge lamp while lit.

Japanese Unexamined Patent Publication No. TOKUKAI 2001-230089 discloses a lighting device including a plurality of lighting means connected in parallel to each other.

Japanese Unexamined Patent Publication No. TOKUKAI 2003-229289 discloses a discharge lamp lighting device including a timer means integrating the time, in the period after the start of operation and before the steady operation, until a detected discharge lamp property exceeds the threshold value and a determination means which determines the type of the discharge lamp based on the length of time integrated at the timer means.

SUMMARY OF THE INVENTION

According to one aspect of the present invention, a high-intensity discharge lamp operating device includes a power supplier, a memory, a detector, a power supplier controller, a lamp power identifier, and a data set selection unit. The power supplier is configured to supply power to a high-intensity discharge lamp connected to the power supplier. The memory contains a starter power data set, an identifying power data set and a plurality of steady power data sets. The detector is configured to detect voltage applied to the high-intensity discharge lamp. The power supplier controller is configured to control the power supplier to control the power supplied from the power supplier to the high-intensity discharge lamp according to the starter power data set, the identifying power data set and one of the plurality of steady power data sets. The lamp power identifier is configured to identify a lamp power of the high-intensity discharge lamp based on the voltage detected by the detector while the power supplier controller controls the power according to the identifying power data set after the power supplier controller controlled the power according to the starter power data set. The data set selection unit is configured to select the one steady power data set from the plurality of steady power data sets based on the lamp power identified by the lamp power identifier. The power supplier controller is also configured to control the power according to the one steady power data set after the data set selection unit selects the one steady power data set.

According to another aspect of the present invention, a high-intensity discharge lamp operating device includes a power supplier, a lamp power setting unit, a memory, and a control circuit. The power supplier is configured to supply power to a high-intensity discharge lamp connected to the power supplier. The power supplier has an output terminal, and one of the high-intensity discharge lamp and impedance is connected to the output terminal. The lamp power setting unit is configured to determine a setting value of a lamp power based on the impedance. The memory is configured to store the setting value determined by the lamp power setting unit. The control circuit is configured to control the power supplier to control the power supplied from the power supplier to the high-intensity discharge lamp according to the setting value of the lamp power.

According to yet another aspect of the present invention, a controlling device for a high-intensity discharge lamp includes a memory, a power supplier controller, a lamp power identifier and a data set selection unit. The memory contains a starter power data set, an identifying power data set and a plurality of steady power data sets. The power supplier controller is configured to control power supplied from a power supplier to the high-intensity discharge lamp according to the starter power data set, the identifying power data set and one of the plurality of steady power data sets. The lamp power identifier configured to identify a lamp power of the high-intensity discharge lamp based on voltage applied to the high-intensity discharge lamp while the power supplier controller controls the power according to the identifying power data set after the power supplier controller controlled the power according to the starter power data set. The data set selection unit is configured to select the one steady power data set from the plurality of steady power data sets based on the lamp power identified by the lamp power identifier. The power supplier controller is configured to control the power according to the one steady power data set after the data set selection unit selects the one steady power data set.

According to yet another aspect of the present invention, a method for controlling a high-intensity discharge lamp includes providing a starter power data set, an identifying power data set and a plurality of steady power data sets, controlling power supplied from a power supplier to the high-intensity discharge lamp according to the starter power data set, the identifying power data set and one of the plurality of steady power data sets, identifying a lamp power of the high-intensity discharge lamp based on voltage applied to the high-intensity discharge lamp while the power is controlled according to the identifying power data set after power is controlled according to the starter power data set, selecting the one steady power data set from the plurality of steady power data sets based on the identified lamp power, and the power is controlled according to the one steady power data set after the one steady power data set is selected.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
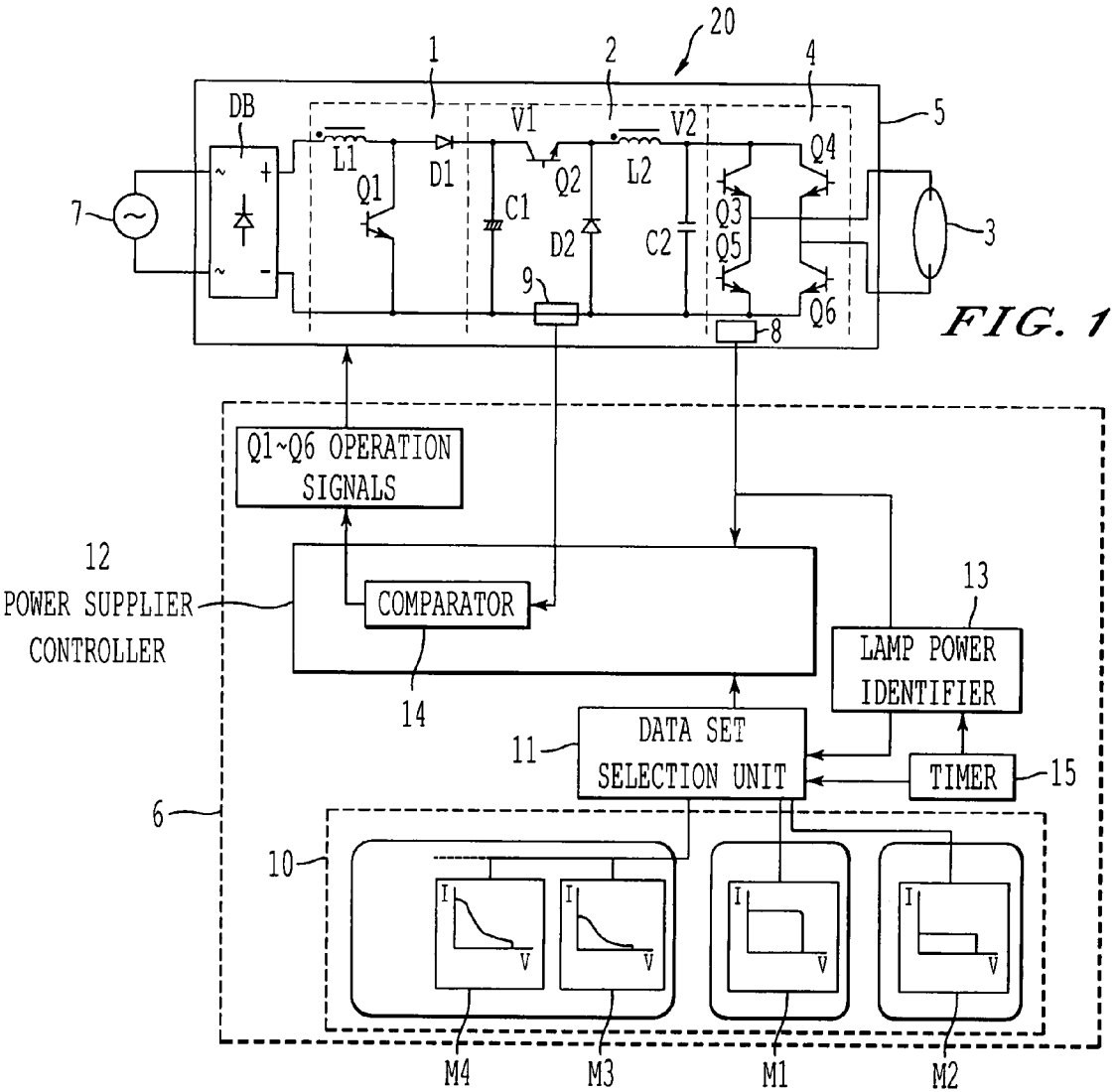
FIG. 1 is a block diagram of a high-intensity discharge lamp according to the first embodiment.
Figure 2A:
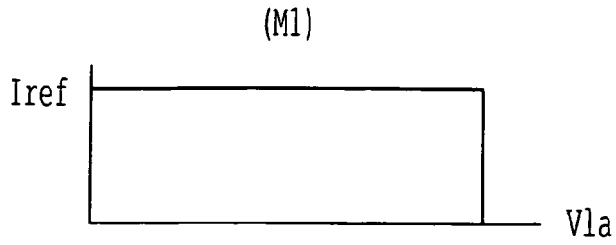
FIGS. 2(*a*)–2(*d*) are graphs showing examples of maps selected in various operation modes, FIG. 2(*a*) being a map for a starter power mode, FIG. 2(*b*) being a map for an identifying power mode, and FIGS. 2(*c*) and 2(*d*) being maps for a steady power mode.
Figure 2B:
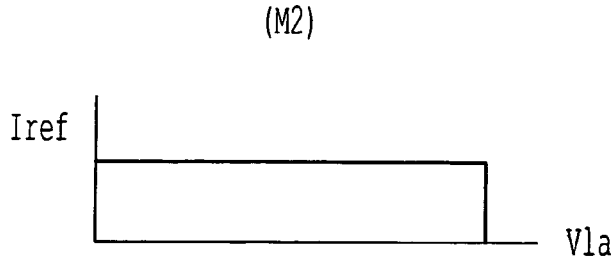
Figure 2C:
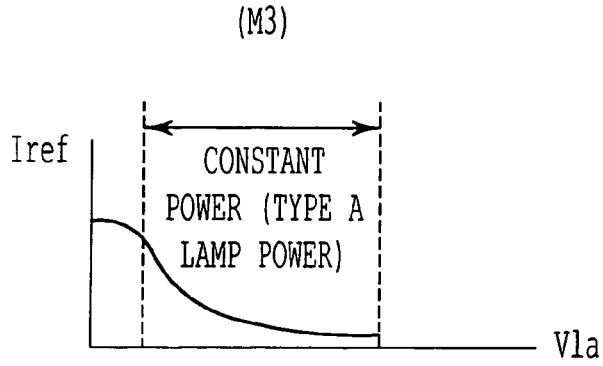
Figure 2D:
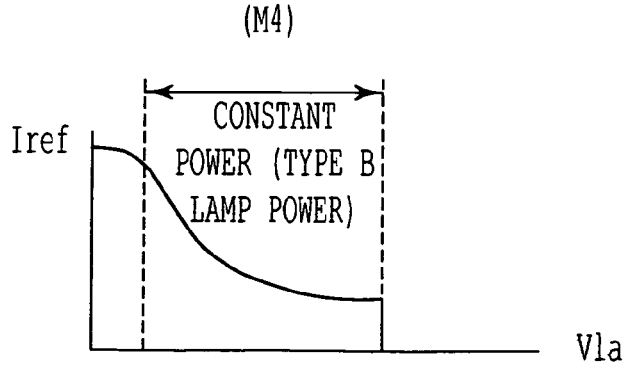

The embodiments will now be described with reference to the accompanying drawings, wherein like reference numerals designate corresponding or identical elements throughout the various drawings.

FIG. 1 is a block diagram of a high-intensity discharge lamp operating device according to a first embodiment of the present invention. The high-intensity discharge lamp operating device (hereinafter referred to as "HID lamp operating device") 20 includes a power supplier 5 and a control circuit 6 connected to the power supplier 5. The power supplier 5 is connected to an AC power source 7 and an HID lamp 3, and configured to supply power to the HID lamp 3. The power supplier 5 includes a chopper 1 for power factor correction, a step-down chopper 2, an inverter 4 and a rectifier (DB). The chopper 1 includes a switching element (QI), an inductor (L1) and a diode (D1). The step-down chopper 2 includes a switching element (Q2), an inductor (L2), a diode (D2), a capacitor (C1) and a capacitor (C2). The inverter 4 includes switching elements (Q3)–(Q6). The rectifier (DB) is connected to the AC power source 7 and produces a pulse which is converted to a DC voltage (V1) by the chopper 1. The chopper 2 produces a voltage (V2) from the voltage (V1), and the inverter 4 converts the voltage (V2) to a rectangular-wave voltage and supplies the voltage to the HID lamp 3. The control circuit 6 includes a memory 10, a data set selection unit 11, a lamp power identifier 13, a timer 15 and a power supplier controller 12 which has a comparator 14. A voltage detector 8 which detects the lamp voltage (V1a) applied to the HID lamp 3 is connected to the power supplier controller 12 and the lamp power identifier 13. The voltage detected by the voltage detector 8 may be voltage which represents the lamp voltage (V1a). A current detector 9 which detects the lamp current (I1a) supplied to the HID lamp 3 is connected to the comparator 14. The current detected by the current detector 9 may be current which represents the lamp current (I1a). The memory 10 contains at least one data sets of the control circuit 6, including a starter power data set, an identifying power data set and a plurality of steady power data sets. The control circuit 6 operates in each of these operation modes according to one of the data sets, for example, maps (M1)–(M4) shown in FIGS. 2(*a*)–2(*d*). FIG. 2(*a*) is the map (M1) for the starter power mode, FIG. 2(*b*) is the map (M2) for the lamp power identifying mode, and FIGS. 2(*c*) and 2(*d*) are the maps (M3) and (M4), respectively, which correspond to the steady power modes. The memory 10 contains a plurality of maps for the steady power mode, and the data set selection unit 11 selects one of the maps for the steady power mode depending on the lamp power of the HID lamp 3. Each of the maps (M1)–(M4) indicates a reference lamp current (Iref) corresponding to a lamp voltage (V1a). As long as the memory 10 stores such a relationship between the reference lamp current (Iref) and the lamp voltage (V1a) in an effective manner, the memory 10 may include any structure, for example, a RAM (Random Access Memory), a ROM (Read Only Memory), and an electric circuit including a number of circuit elements.

Referring back to FIG. 1, the data set selection unit 11 is configured to select one steady power data set according to the lamp power of the HID lamp 3. The power supplier controller 12 is configured to control the power according to the steady power data set after the data set selection unit 11 selects one steady power data set. The power supplier controller 12 may be configured to control current and/or voltage. The comparator 14 is configured to compare the lamp current (I1a) with the reference lamp current (Iref). The power supplier controller 12 is configured to control the power supplied from the power supplier 5 to the HID lamp 3. Specifically, the power supplier controller 12 is configured to regulate the lamp current (I1a) so that the detected lamp current (I1a) stays substantially constant at the value of the reference lamp current (Iref) after the comparator 14 compares the lamp current (I1a) with the reference lamp current (Iref). The lamp power identifier 13 is configured to identify a lamp power of the HID lamp 3 based on the lamp voltage (V1a) detected by the voltage detector 8. The lamp voltage (V1a) to be detected may be a differential voltage between the two ends of the HID lamp 3. Alternatively, the voltage between the two ends of the capacitor (C2) may be treated as equivalent to the lamp voltage (V1a). Based on the lamp power identified by the lamp power identifier 13, the data set selection unit 11 selects one steady power data set, and then the power supplier controller 10 controls the power according to the selected steady power data set. The data set selection unit 11 selects one of the maps depending on the lamp power identified by the lamp power identifier 13.

Figure 3:
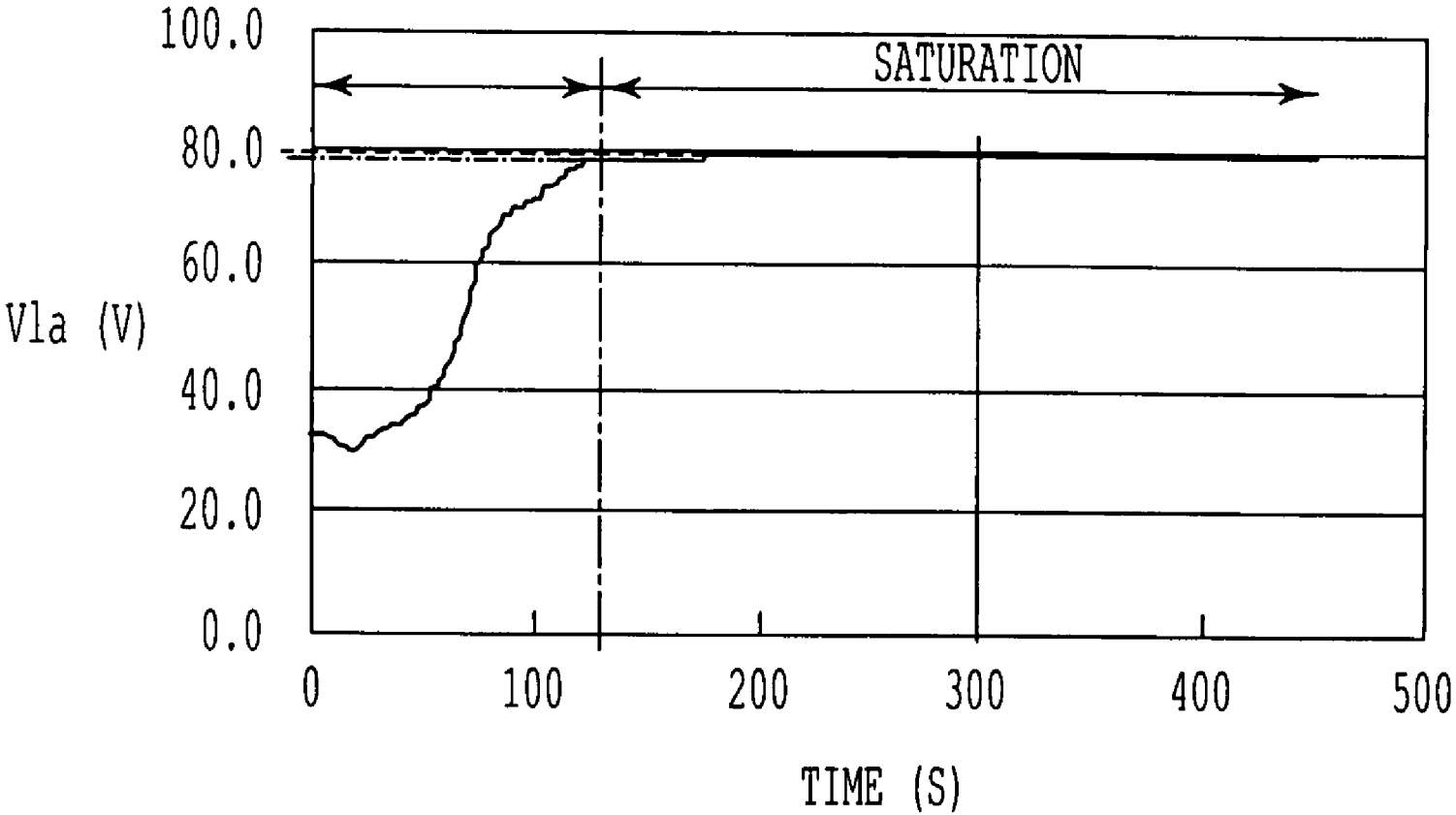
FIG. 3 is a graph showing a temporal variation in a lamp voltage (V1a) of an HID lamp, for example, a ceramic metal halide lamp receiving a constant current.

Referring to FIG. 3, electric characteristics of an HID lamp are described below. FIG. 3 shows an actual measurement obtained by applying a constant current of about 0.4 A to a ceramic metal halide lamp (manufactured by General Electric Company; lamp power: 39W) as an example of the HID lamp. FIG. 3 is a graph showing a temporal variation in the lamp voltage (V1a) of an HID lamp driven by a constant current. The lamp voltage (V1a) gradually increases at the initial stage and becomes substantially constant after a certain period of time. In this example, the lamp voltage became saturated about two minutes after the HID lamp was turned on. This "saturation" of the voltage is defined here as the state where the variation in the voltage stays within a range of ±1%, and after the voltage saturation, the operation of an HID lamp may be considered as substantially stable. Although it depends on the characteristics of an HID lamp and its operating device, the lamp voltage is usually saturated about five to ten minutes after the HID lamp is turned on. The voltage saturation may be achieved as early as one minute after starting the operation. The lamp power identification may be performed anytime when the lamp power is identifiable without being adversely effected by detection errors of the lamp voltages.

Next, an overall operation of the HID lamp operating device 20 according to the present embodiment is briefly described. The HID lamp operating device 20 turnes on the HID lamp 3 by applying a substantially constant current to the HID lamp 3. The lamp voltage (V1a) of the HID lamp 3 gradually increases at the initial stage of power supply as shown in FIG. 3. The data set selection unit 11 selects a map for the starter power mode, for example, the map shown in FIG. 2(*a*). In this starter power mode map, the reference lamp current (Iref) has a constant value. Thus, the power supplier controller 12 performs the control of the lamp current (I1a) so that the detected lamp current (I1a) stays substantially constant at the value of the reference lamp current (Iref). Then, after the operation mode is switched to the identifying power mode, the data set selection unit 11 selects the map for the identifying power mode, for example, the map shown in FIG. 2(*b*), and the power supplier controller 12 performs the control so that the HID lamp 3 receives a constant current. Specifically, the power supplier controller 12 reads the value of the reference lamp current (Iref) from the map, the comparator 14 compares the values of the detected lamp current (I1a) with the reference lamp current (Iref), and the power supplier controller 12 adjusts the lamp current (I1a) to the reference lamp current (Iref). After the power supplier controller 12 maintains the lamp current (I1a) substantially constant at the reference lamp current (Iref), the lamp power identifier 9 identifies the lamp power of the HID lamp 3 based on the detected lamp voltage (V1a), and then sends a command signal to the data set selection unit 11 to select the map for the steady power mode. After receiving the command signal, the data set selection unit 11 selects the map corresponding to the identified lamp power of the HID lamp 3, and the operation mode is switched to the steady power mode. The power supplier controller 12 regulates the lamp current (I1a) according to the map so that the HID lamp 3 operates with its rated lamp power.

Figure 4A:
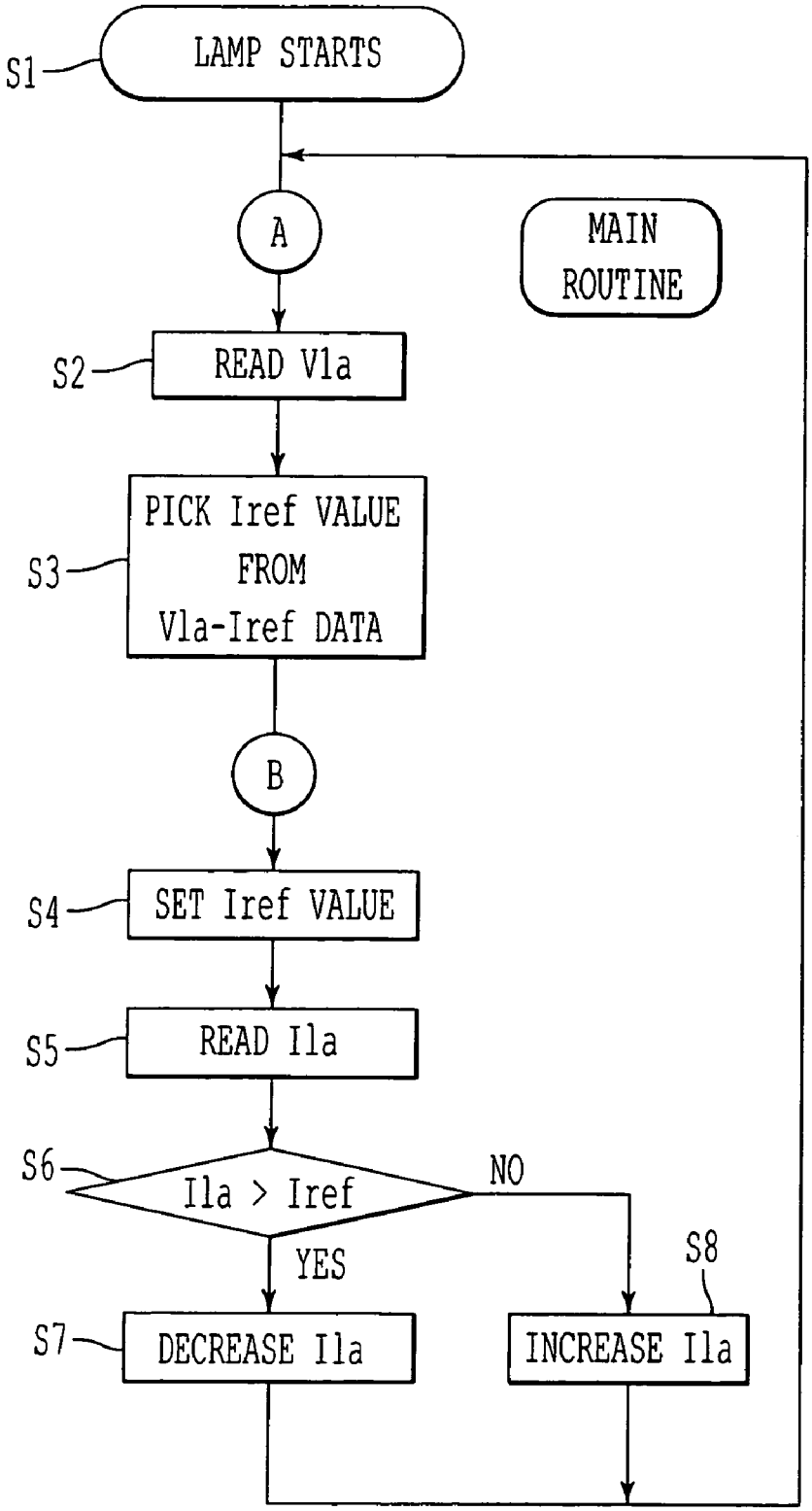
FIGS. 4(*a*) and 4(*b*) are flowcharts showing operation steps of a power supplier controller of the high-intensity discharge lamp operating device according to the first embodiment.
Figure 4B:
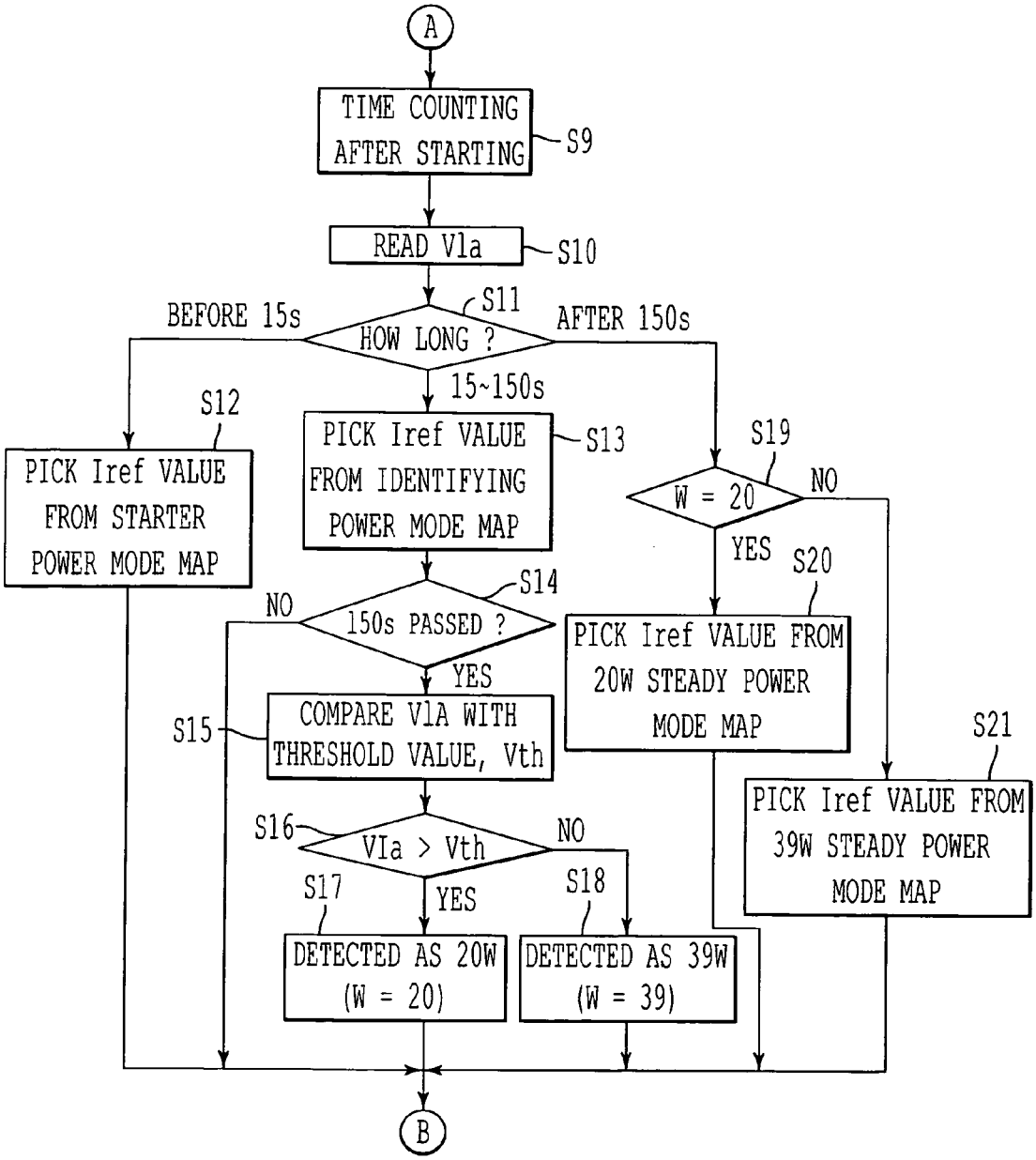

Referring to FIGS. 4(*a*) and 4(*b*), the operation of the HID lamp operating device 20 according to the present embodiment will be explained in more details. FIG. 4(*a*) shows the steps of a main routine that the power supplier controller 12 performs while the HID lamp 3 is turned on. FIG. 4(*b*) shows in details the actual steps between the node (A) and node (B) of the main routine shown in FIG. 4(*a*), and FIG. 4(*b*) corresponds to the case where two types of HID lamps, a type (A) lamp having a lamp power of 20 W and a type (B) lamp having a lamp power of 39 W are to be distinguished. The HID lamp operating device 20 starts operation in step S1. In step S2, the voltage detector 8 detects the lamp voltage (V1a), and in steps S3 and S4, the power supplier controller 12 reads the reference lamp current (Iref) from the map and sets the (Iref) value. The current detector reads the lamp current (I1a) value in step S5. In step S6, the comparator 12 compares the detected lamp current (I1a) with the reference lamp current (Iref). If (I1a) > (Iref), the power supplier controller 12 decreases the lamp current (I1a) (step S7). If (I1a) < (Iref), then the power supplier controller 12 increases the lamp current (I1a) (step S8). The power supplier controller 12 repeats these steps until the lamp current (I1a) reaches the (Iref) value.

Referring to FIG. 4(*b*), the actual operation steps of the HID lamp operating device 20 according to the current embodiment are discussed. The HID lamp operating device 20 includes the timer 15 that counts the time (T) /sec after starting the operation, and in step S11, the data set selection unit 11 selects one of the data sets depending on the length of time after the start of operation. In the steps shown in FIG. 4(*b*), for example, if (T)< 15 sec, the data set selection unit 11 selects the starter power map (step S12), if 15 sec≦(T)≦150 sec, the data set selection unit 11 selects the identifying power map (step S13), and if (T)>150 sec, the data set selection unit 11 selects one of the stead power map (step S20 or S21), depending on the lamp power identified by the lamp power identifier 13. In this example, at (T)=150, the lamp power identifier 13 performs the lamp power identification (steps S15–S18). In step S15, the lamp power identifier 13 compares the lamp voltage (V1a) with a predetermined threshold voltage (Vth), and identifies the lamp power depending on the comparison result. If the lamp power identifier 13 identifies the lamp power of the HID lamp 3 as 20 W (step S17), the data set selection unit 11 selects the steady power map for 20 W (step S20). Like wise, if the lamp power identifier 13 identifies the lamp power as 39 W (step S18), the data set selection unit 11 selects the map for 39 W, and then the operation goes back to the main routine.

Figure 5:
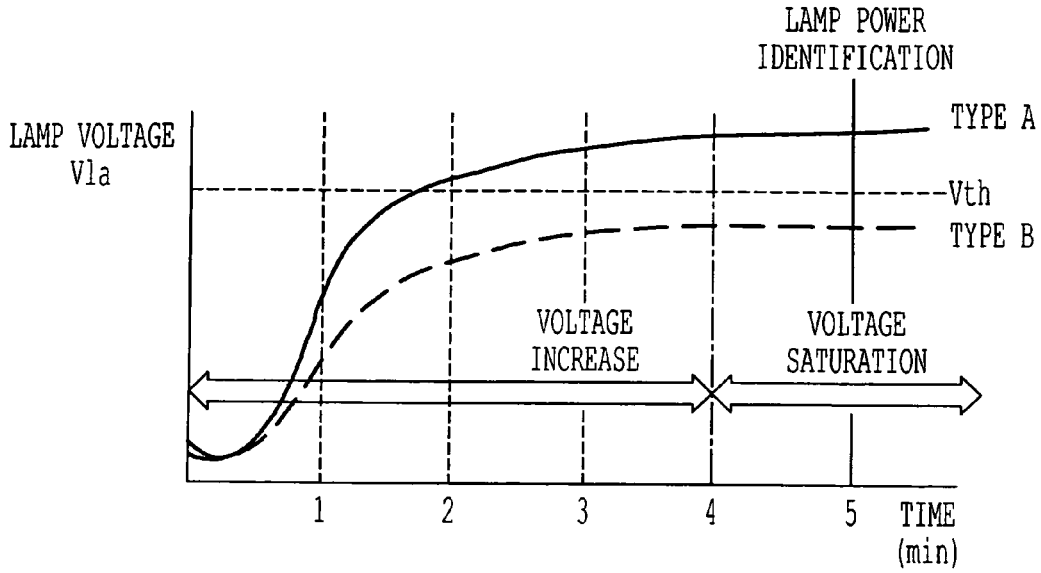
FIG. 5 is a graph showing a temporal variation in the lamp voltage (V1a) of HID lamps having different lamp powers that are identified after a saturation of the lamp voltage (V1a)

As discussed above, the lamp power identifier 13 identifies the lamp power based on the comparison between identifying voltage, i.e., the lamp voltage (V1a) in this example, and the threshold voltage (Vth). FIG. 5 shows how the lamp power identification is performed based on such a comparison. FIG. 5 is a graph showing a temporal variation in the lamp voltage (V1a) obtained by applying a constant current to each of the HID lamps of two types, type (A) and type (B). The type (A) lamp has a lamp power of 20 W, while the type (B) lamp has a lamp power of 39 W. These lamps exhibit a gradual increase in the lamp voltage (V1a) at the initial stage of the power supply. After the voltage saturation, at (T)=150 for example, the lamp voltage (V1a) of the type (A) lamp is greater than the threshold voltage (Vth), whereas the lamp voltage (V1a) of the type (B) lamp is smaller than the threshold voltage (Vth). Based on the comparison between identifying voltage, i.e., the lamp voltage (V1a), of each lamp type and the threshold voltage (Vth), the lamp power identifier 13 identifies the lamp power of the HID lamp 3. It should be noted that the timing of this lamp power identification is not limited to five minutes after the operation start as in this example, and it may be anytime after the lamp voltage (V1a) achieves a substantial saturation. When completing the lamp power identification, the lamp power identifier 13 sends a signal commanding the data set selection unit 11 to select the map corresponding to the identified lamp power of the HID lamp 3. Then, the power supplier controller 12 controls the power according to the map selected by the data set selection unit 11 so that the HID lamp 3 is operated with its rated lamp power. As described above, the HID lamp operating device 20 according to the present embodiment includes the lamp power identifier 13 configured to identify the lamp power of the HID lamp 3 based on the voltage detected by the voltage detector 8 while the power supplier controller 12 controls the power according to the identifying power data set after the power supplier controller 12 controlled the power according to the starter power data set. Specifically, the lamp power identification is performed only after the operation mode is switched from the starter power mode to the identifying power mode in which the power supplier controller 12 performs the control separate from regular controls for lighting the HID lamp 3. As such, the current control by the power supplier controller 12 is performed effectively and precisely for the lamp power identification, and thus the lamp power identifier 13 performs a reliable and accurate identification of the lamp power of the HID lamp 3.

Figure 6:
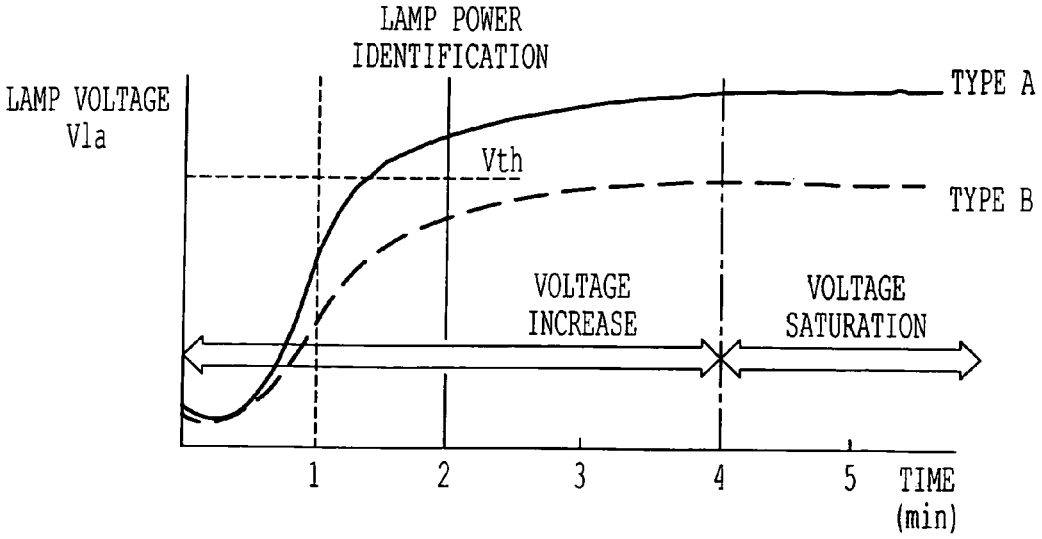
FIG. 6 is a graph showing a temporal variation in the lamp voltage (V1a) of HID lamps having different lamp powers that are identified before the saturation of the lamp voltage (V1a) according to a second embodiment.

In the first embodiment, the lamp power identifier 13 identifies the lamp power based on the lamp voltage (V1a) after saturation. In a second embodiment, as shown in FIG. 6, the lamp power identifier 13 performs the identification based on identifying voltage before the lamp voltage (V1a) becomes saturated, but after the lamp voltage (V1a) is sufficiently increased and the lamp power of the HID lamp 3 is identifiable without being adversely effected by measurement errors, for example, voltage measurement errors and/or the variation in characteristics among the individual HID lamps of the same type. Also, the timing of the lamp power identification may be anytime while the lamp voltage (V1a) is increasing, if the lamp powers of the HID lamps of interest are distinguishable by comparing the values of the lamp voltage (V1a) with the threshold value (Vth) as shown in FIG. 6. In this embodiment, since the identification is performed before the lamp voltage (V1a) becomes saturated at a higher voltage, the HID lamp 3 receives less stress compared with the case where the HID lamp 3 continuously receives a higher voltage until the lamp power identifier 13 performs the lamp power identification.

Figure 7:
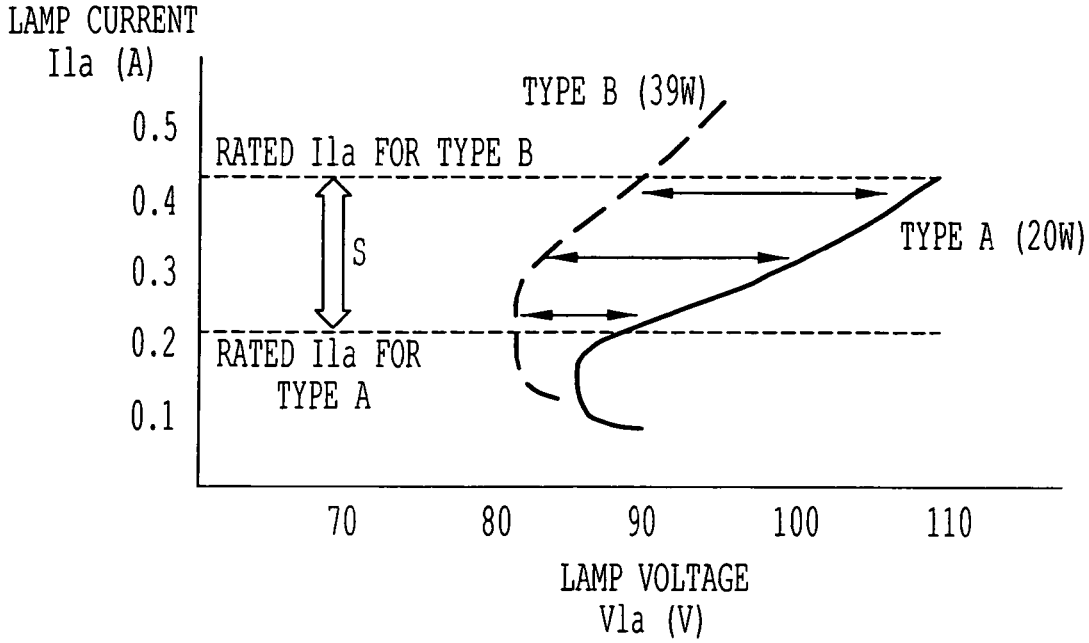
FIG. 7 is a graph showing a range (S) of a lamp current (I1a) supplied in the identifying power mode according to a third embodiment.

The third embodiment discusses the selection of an effective lamp current (I1a) supplied to the HID lamp 3 in the identifying power mode. First, static lamp characteristics of HID lamps are considered. FIG. 7 shows static lamp characteristics of an HID lamp of type (A) having a lamp power of 20 W (solid line), and an HID lamp of type (B) having a lamp power of 39 W (dotted line). The static lamp characteristics of an HID lamp determine the lamp voltage (V1a) applied to the HID lamp when the HID lamp receives a certain lamp current (I1a), and the HID lamp exhibits different characteristics depending on the amount of the lamp current (I1a) supplied to the HID lamp. When the HID lamp receives a relatively large current (I1a), the lamp voltage (V1a) increases as the lamp current (I1a) becomes larger, which is the positive characteristics like the resistance. On the other hand, if the supplied lamp current (I1a) is relatively small, the HID lamp exhibits the negative characteristics, and the lamp voltage (V1a) decreases as the lamp current (I1a) becomes larger. If the amount of the lamp current (I1a) is somewhere between these two ranges, the lamp voltage (V1a) stays substantially constant independently of the lamp current (I1a), which is indicated by the substantially vertical line in FIG. 7. In distinguishing the type (A) lamp from the type (B) lamp exhibiting the characteristics shown in FIG. 7, the lamp current (I1a) is set so that the lamp voltages of the two lamps differ by a sufficient amount allowing the effective lamp power identification. Therefore, in the present embodiment, the lamp current (I1a) to be supplied in the identifying power mode falls within the range (S) shown in FIG. 7, which is between rated lamp currents of the type (A) lamp and type (B) lamp. The rated lamp current (rated I1a) is the current that supplies the rated power of the HID lamp, and determined by the static characteristics of the HID lamp. By supplying the lamp current (I1a) within this range (S), the lamp voltages of the two lamps differ by a sufficient amount (shown by horizontal arrows in FIG. 7), and thus the lamp power identifier 13 of the present embodiment performs effective and reliable identification of the lamp power of the HID lamp. In this example, as the current becomes larger, a greater amount of stress would be imposed on the type (A) lamp having a smaller lamp power, whereas a smaller current might not supply sufficient power to the type (B) lamp having a greater lamp power. Therefore, in terms of balancing the two effects, it is also advantageous to select the lamp current (I1a) within the range (S) as in the current embodiment.

Figure 8:
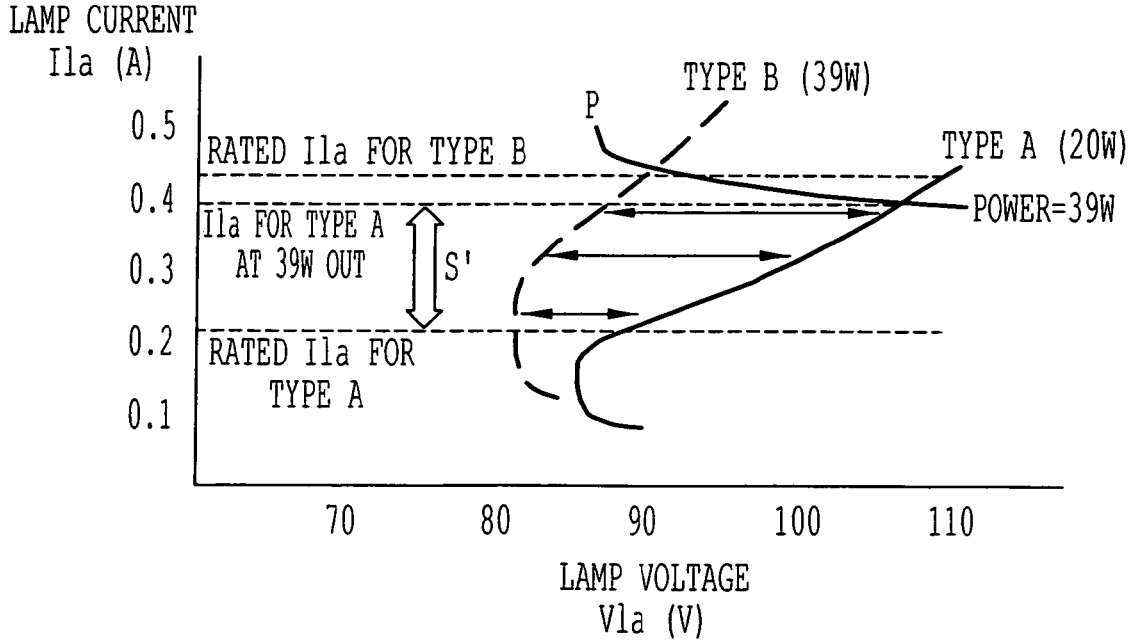
FIG. 8 is a graph showing a range (S') of the lamp current (I1a) supplied in the identifying power mode in relation to the static characteristics of HID lamps.

In view of the greater stress that the type (A) may receive than the type (B) lamp, the lamp current (I1a) may be further limited as shown in FIG. 8 so that the power supplied by the power supplier 5 does not exceed the largest lamp power among the HID lamps to be operated by the HID lamp operating device 20. In this example, since the largest lamp power is 39 W, the upper limit of the range (S') is set by the line (P) showing the V-I relationship of the HID lamp 3 operated with the lamp power of 39 W. Since the lamp current (I1a) is selected within this range (S'), the lamp power identification does not require an excessive power supply, and thus the manufacturing cost is lowered or the circuit is made smaller. In the above embodiments, the power supplier 12 controls the power supplier to control the current supplied from the power supplier 5 to the HID lamp 3 to be substantially constant current while the power supplier controller 12 controls the power supplier 5 according to the map for the identifying power mode. However, the power supplier 12 may control the power supplier 5 to control the power supplied to the HID lamp 3 to be substantially constant as in the following embodiment.

Figure 9:
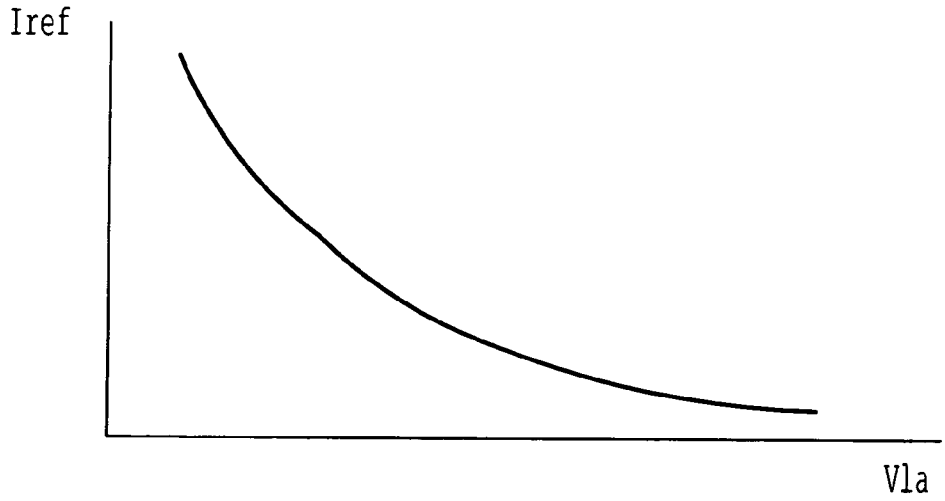
FIG. 9 is a graph showing a map selected in an identifying power mode of a power supplier controller of a high-intensity discharge lamp operating device according to a fourth embodiment.
Figure 10:
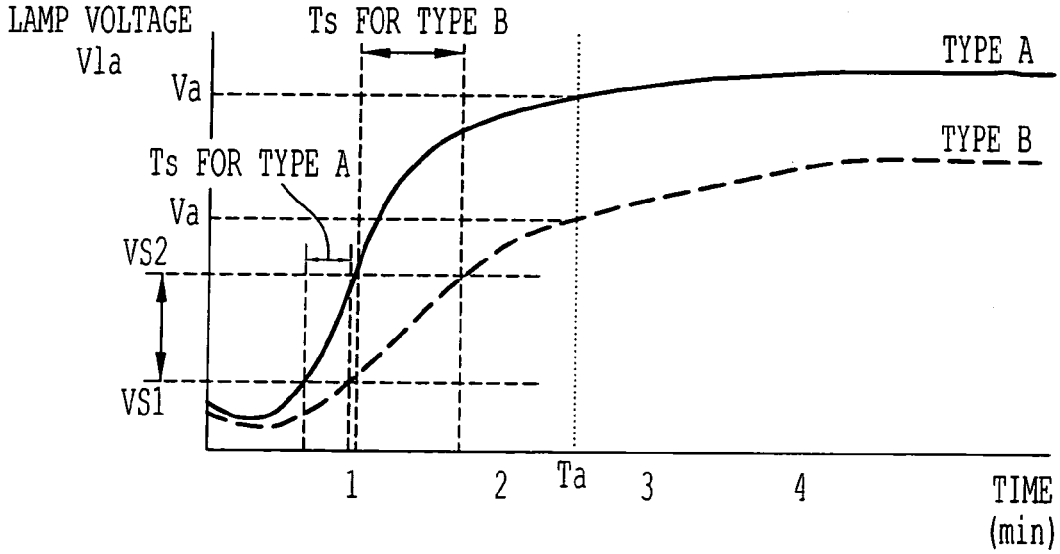
FIG. 10 is a graph showing a temporal variation in a lamp voltage (V1a) of high-intensity discharge lamps having different lamp powers when a power supplier supplies a constant power to the high-intensity discharge lamps.

FIG. 9 shows an example of the map utilized in the identifying power mode according to a fourth embodiment. In this graph, the curve indicates that the power is maintained substantially constant. According to this map, the power supplier controller 12 maintains the lamp power substantially constant in the identifying power mode. When the HID lamp 3 receives a substantially constant power, the lamp voltage (V1a) increases as shown in FIG. 10. The solid line corresponds to the type (A) lamp having a smaller lamp power, and the dotted line corresponds to the type (B) lamp having a greater lamp power. The lamp voltage (V1a) increases at the initial stage of power supply, and then after a certain period of time, the lamp voltage (V1a) becomes substantially constant and saturated. When the type (A) and type (B) lamps receive the same power, the lamp voltage (V1a) of the type (A) lamp having a smaller lamp power increases faster than that of the type (B) lamp. The time (Ts) indicated in FIG. 10 is the time required for the lamp voltage (V1a) to be increased from the voltage (VS1) to the voltage (VS2). It is clear that the time (Ts) is smaller in the type (A) lamp. The lamp power identifier 13 according to the present embodiment identifies the lamp power of the HID lamp 3 by comparing the time (Ts) with a predetermined threshold value (tl). In this example, if (Ts) < (tl), the lamp power identifier 13 identifies the HID lamp 3 as type (A), and if (Ts) > (tl), the HID lamp 3 is identified as type (B). The voltage range from (VS1) to (VS2) is set to be a range in which the lamp voltage is sufficiently increased and the difference in the time (Ts) allows the lamp power identification without being affected by measurement errors and/or individual variations in the lamp characteristics.

Figure 11A:
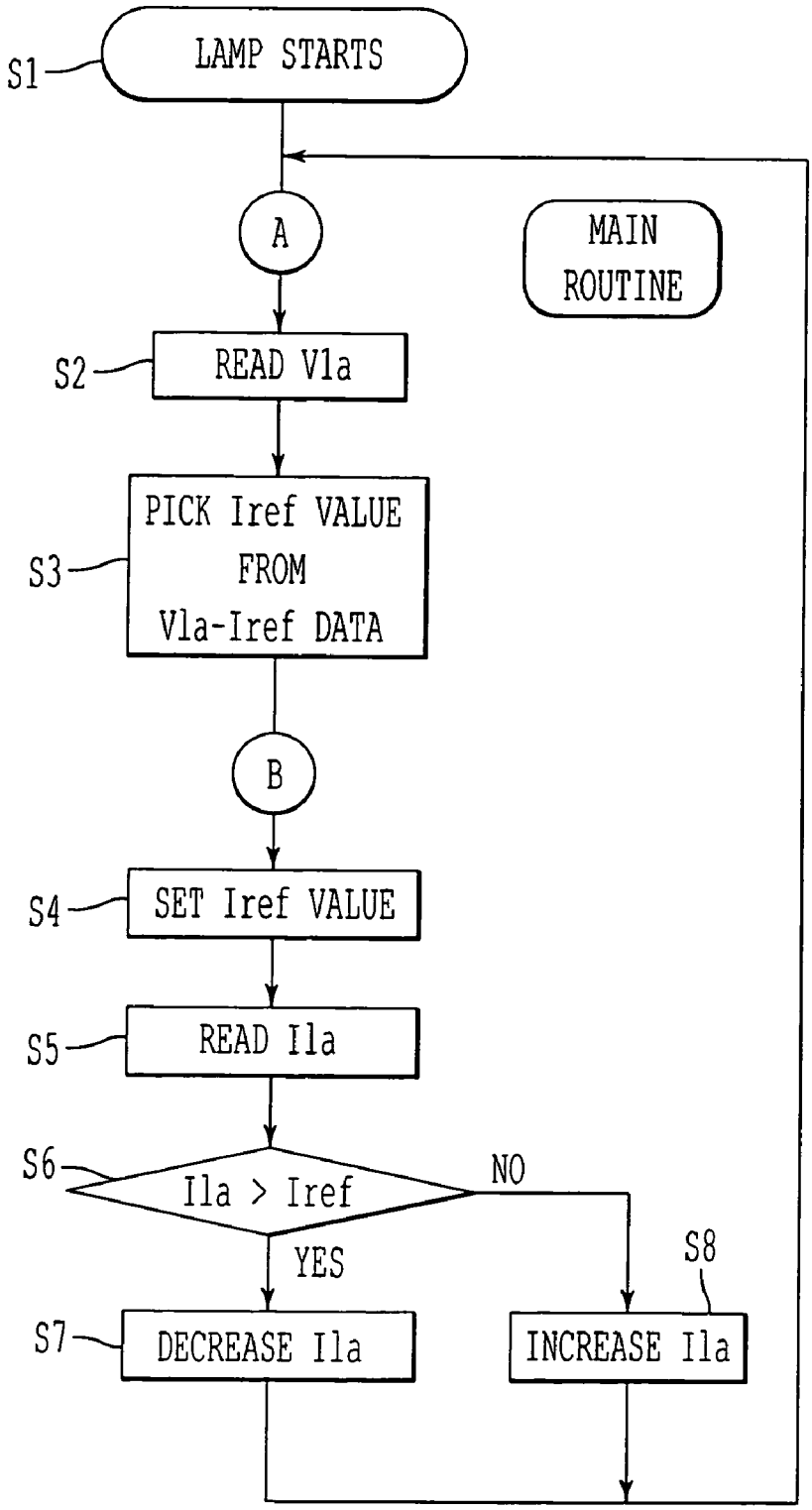
FIGS. 11(*a*) and 11(*b*) are flowcharts showing operation steps of the power supplier controller of a high-intensity discharge lamp operating device according to a fourth embodiment.
Figure 11B:
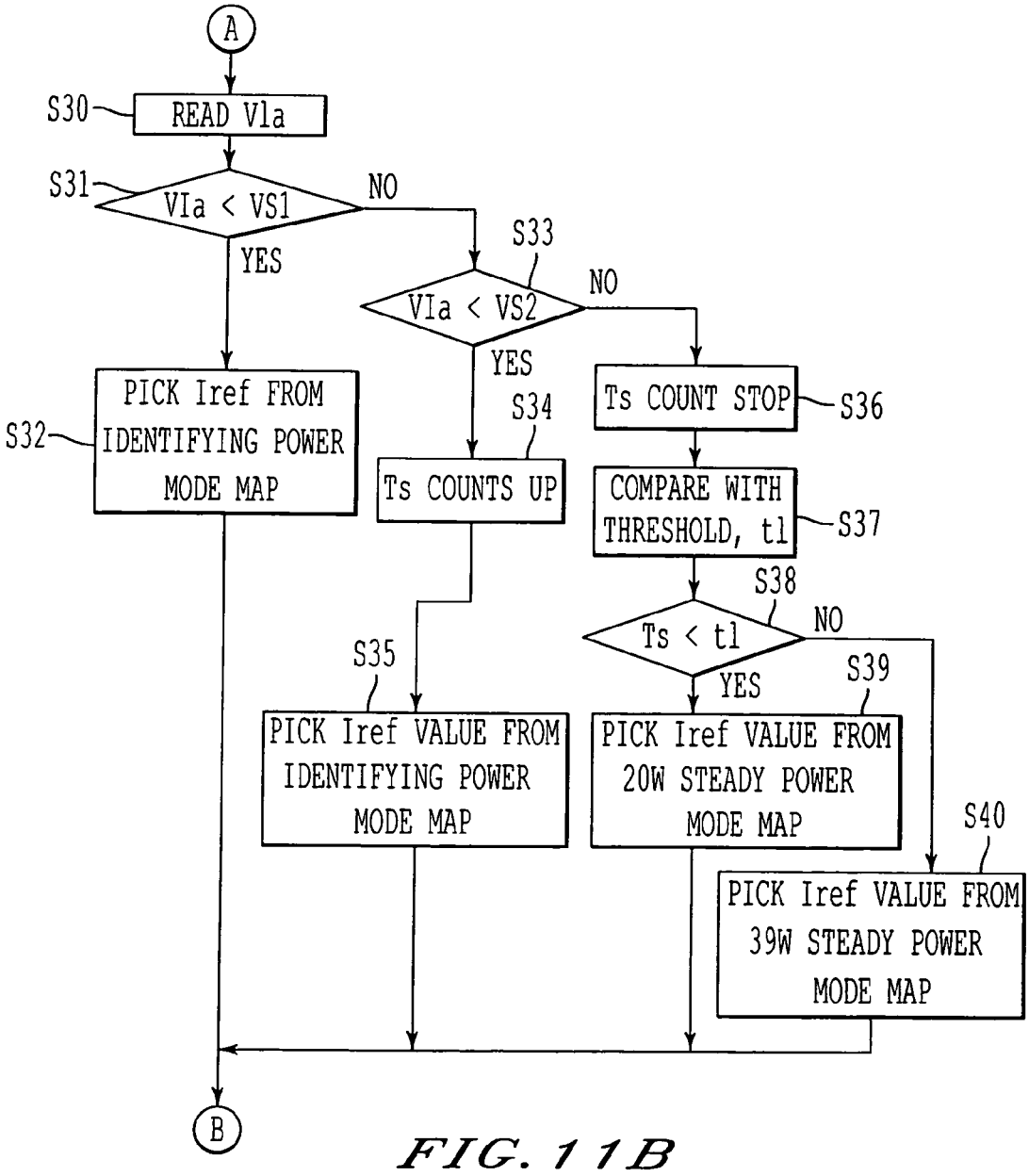

Referring FIGS. 11(*a*) and 11(*b*), the operation steps of the HID lamp operating device of the present embodiment will be described. FIG. 11 (*a*) shows the main routine same as FIG. 4(*a*). FIG. 11(*b*) shows the operation steps after the power supplier controller 12 starts operating in the identifying power mode. According to FIG. 11(*b*), after the voltage detector 8 detects the lamp voltage (V1a), the lamp power identifier 13 compares the detected lamp voltage (V1a) with a predetermined voltage value (VS1) (step S31). While (V1a)<(VS1), the power supplier controller 12 operates in the identifying power mode (step S32). When (V1a) =(VS1), the timer 15 starts counting (Ts), and while (VS1) <(V1a)<(VS2), the timer 15 integrates the time (Ts) and the power supplier controller 12 continues to operate in the identifying power mode (steps S34 and S35). When (V1a) =(VS2), the timer 15 stops counting (Ts). The lamp power identifier 13 compares the counted time (Ts) with the threshold value (tl) (step S38), and performs the lamp power identification as described above. Then, the data set selection unit 11 selects the map corresponding to the identified lamp power, and the operation mode is switched to the steady power mode. In the above embodiment, the power supplier controller 12 controls the power supplier 5 to supply a substantially constant power according to the map as shown in FIG. 9. However, this lamp power identification method based on the time (Ts) may be performed while the power supplier controller 12 controls the power supplier to supply a substantially constant current to the HID lamp 3.

Figure 12:
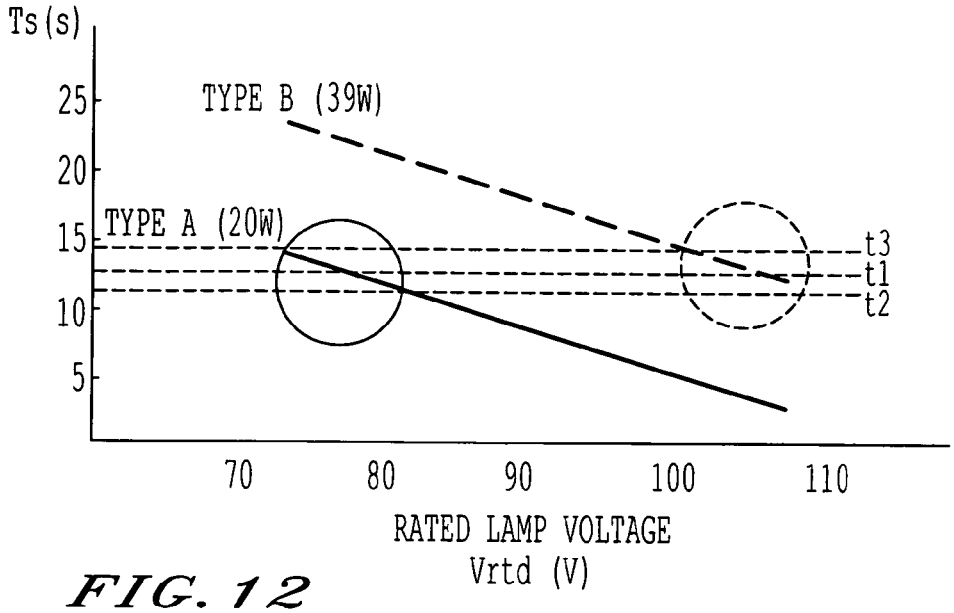
FIG. 12 is a graph showing a variation in the time (Ts) among individual high-intensity discharge lamps having the same lamp power but different rated lamp voltages.
Figure 13:
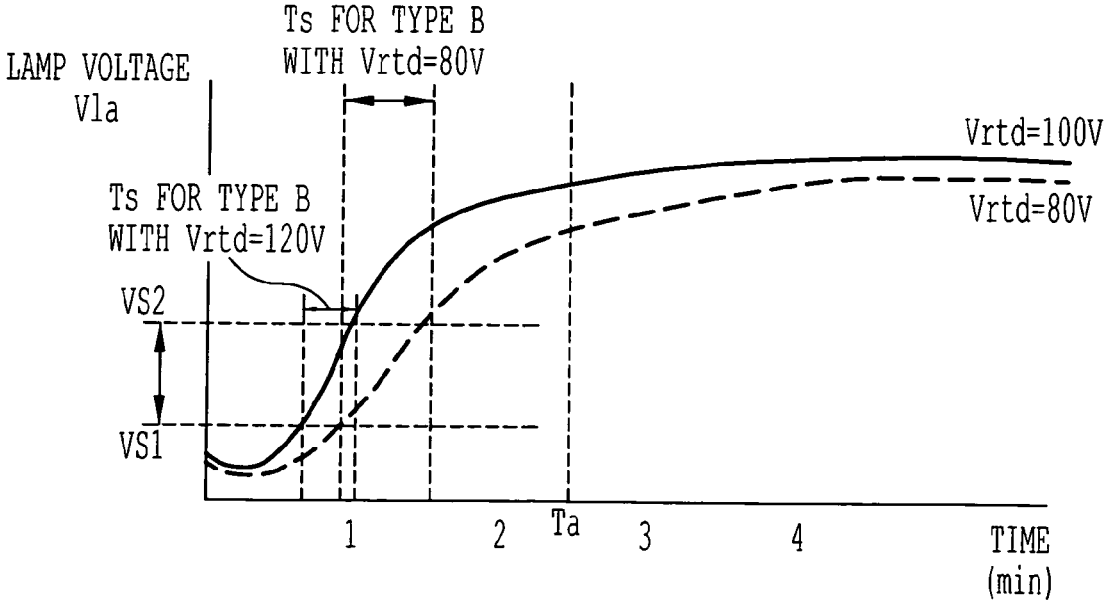
FIG. 13 is a graph showing a temporal variation in a lamp voltage (V1a) of high-intensity discharge lamps having the same lamp power but different rated voltages when a power supplier supplies a constant power to the high-intensity discharge lamps.

A fifth embodiment relates to the case where individual HID lamps of the same lamp power show varying lamp voltages when operated with the same power. FIG. 12 shows such a variation in the rated lamp voltage (Vrtd) among the HID lamps of the same type. For example, some type (B) lamps have the rated lamp voltage (Vrtd) of 110 V , whereas other type (B) lamps have the (Vrtd) value of 75 V. Even the HID lamps of the same type, those with different (Vrtd) values have different (Ts) values, which are indicated by the solid line (type (A) lamps) and by the dotted line (type (B) lamps) in FIG. 12. FIG. 13 also shows the example where the type (B) lamps with different (Vrtd) values have different (Ts) values. In order to distinguish a type (A) lamp from a type (B) lamp based on the value of the time (Ts), the HID lamps of the two types are required to substantially differ in the (Ts) values. However, for example, a type (A) lamp that falls within a solid-line circle and a type (B) lamp that falls within a dotted-line circle have considerably close (Ts) values that make the lamps of two types less distinguishable from each other.

Figure 14:
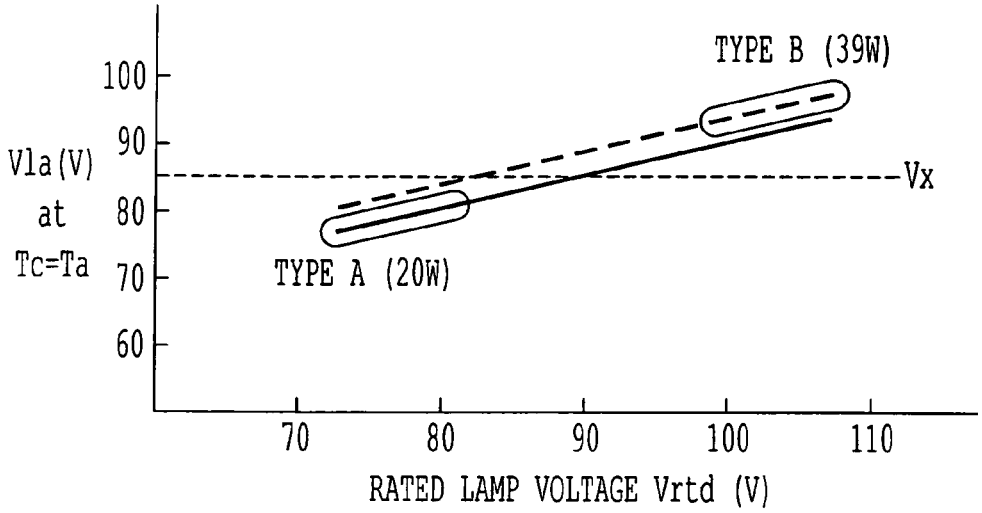
FIG. 14 is a graph showing a variation in the voltage (Va) among individual high-intensity discharge lamps having the same lamp power but different rated lamp voltages.

In order to perform a more reliable distinction between such lamps, the present embodiment provides a method of identifying the lamp power through two steps. In the first step, the lamp power identifier 13 compares the time (Ts) with two threshold values (t2) and (t3) where (t2)<(t3) as shown in FIG. 12. Specifically, the lamp power identifier 13 identifies the HID lamp 3 as type (A) if (Ts)≦(t2), and type (B) if (Ts)>(t3). At the second step, the HID lamps satisfying the relationship (t2)<(Ts)≦(t3), i.e., the lamps that fall within the circles shown in FIG. 12, undergo an identification process based on the voltage (Va), i.e., the lamp voltage (V1a) at the time (Ta) shown in FIGS. 10 and 13. The lamp voltage (V1a) becomes substantially saturated at the time (Ta). FIG. 14 shows the relationship between the rated lamp voltage (Vrtd) and the voltage (Va). According to FIG. 14, as for the type (B) lamp having the lamp power of 39 W and the rated lamp voltage (Vrtd) of about 110 V , the voltage (Va) is about 100 V . On the other hand, the type (B) lamp having the lamp power of 39 W and the rated lamp voltage (Vrtd) of 70 V , the voltage (Va) is about 80 V . As for the type (A) lamp having the lamp power of 20 W and the rated lamp voltage (Vrtd) of about 110 V , the voltage (Va) is about 90 V . On the other hand, the type (A) lamp having the lamp power of 20 W and the rated lamp voltage (Vrtd) of 70 V , the voltage (Va) is about 80 V . In this case, based on the comparison between the value of (Va) and a predetermined threshold voltage (Vx), the lamp power identifier 13 identifies the lamp power of the HID lamp 3. As described above, the HID lamps having close (Ts) values are clearly distinguishable based on the voltage (Va) at the time (Ta).

Figure 15A:
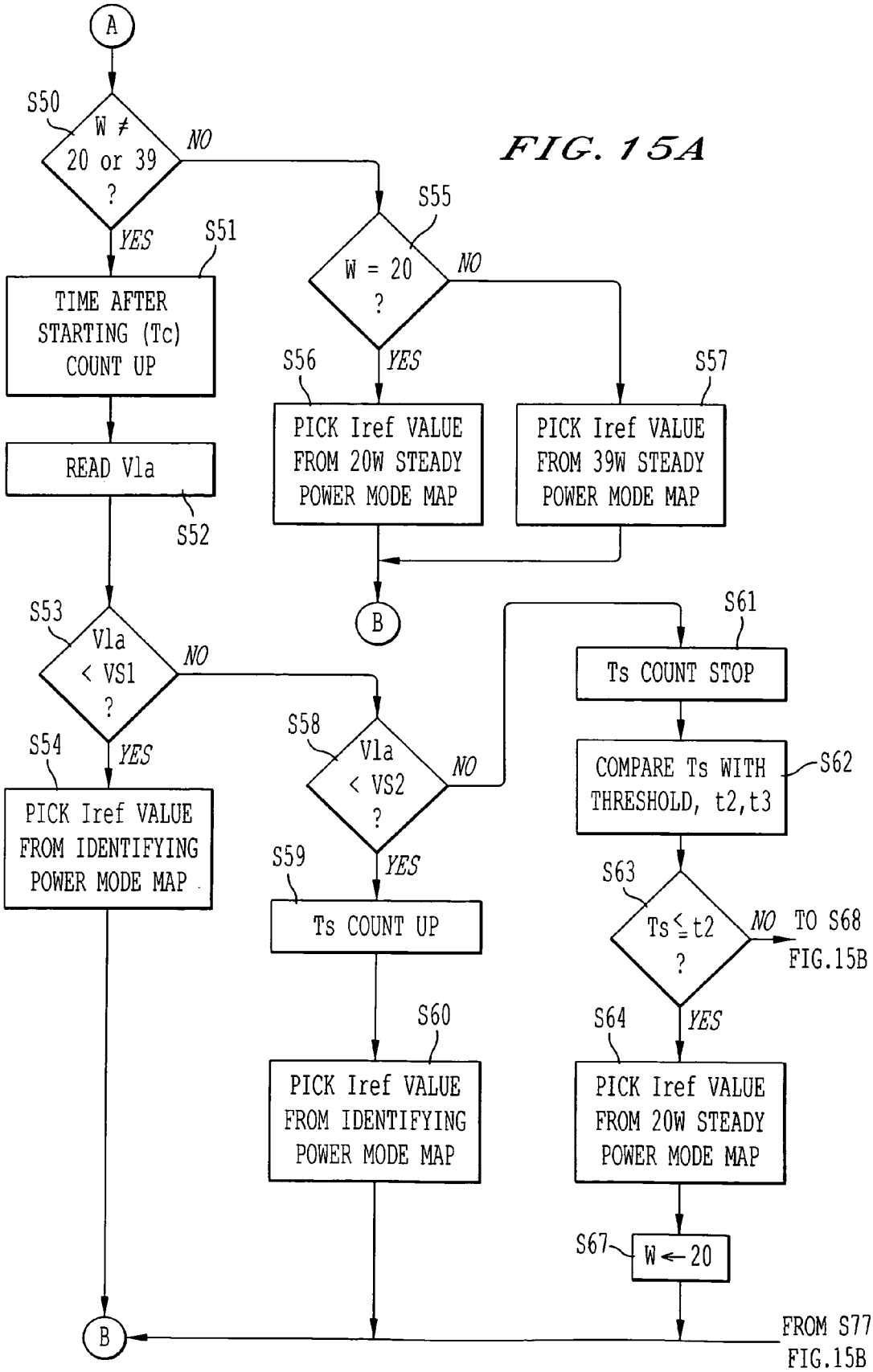
FIG. 15 is a flowchart showing operation steps of a power supplier controller of a high-intensity discharge lamp operating device according to a fifth embodiment.
Figure 15B:
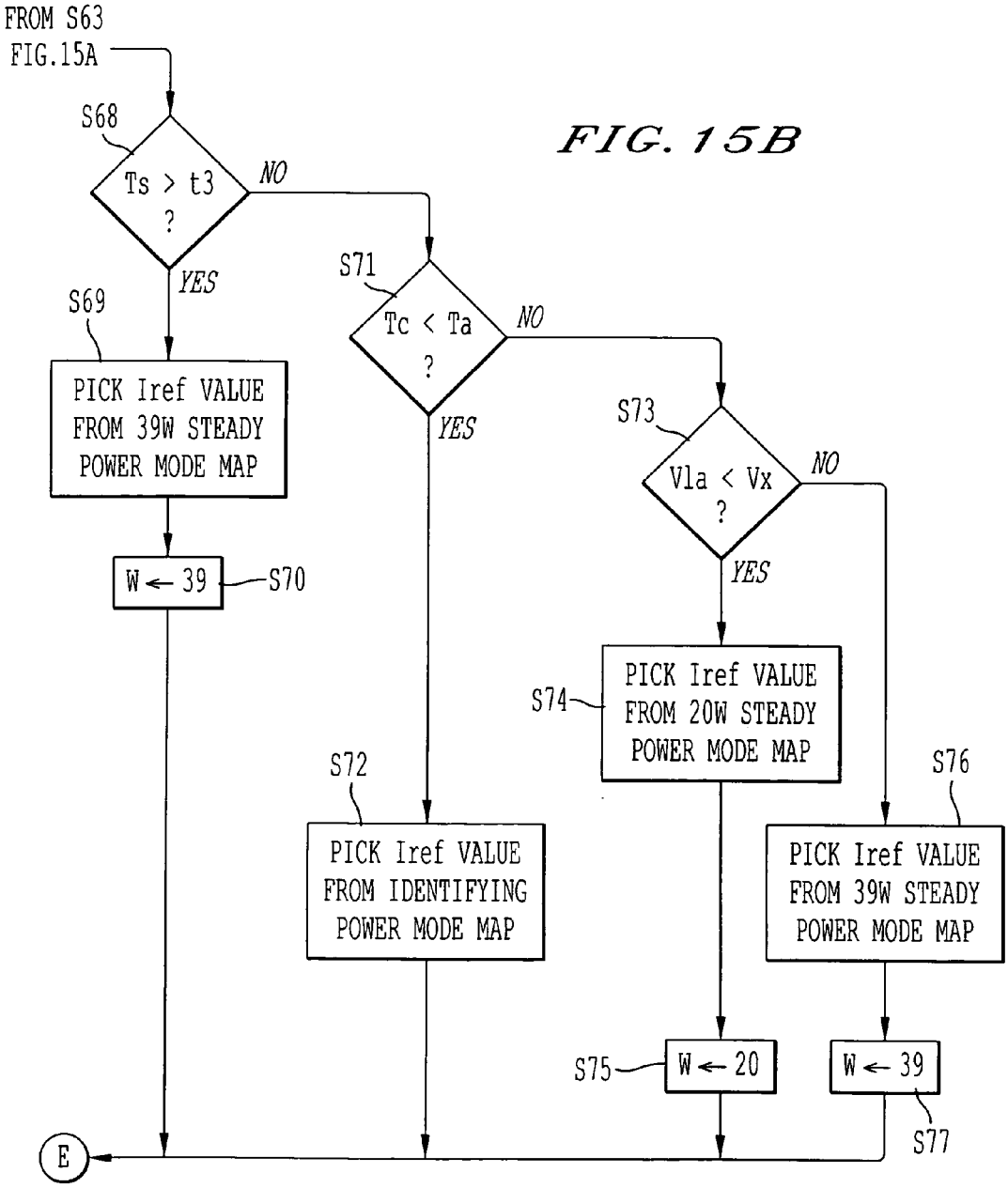

Referring FIG. 15, the actual operation steps of the HID lamp operating device according to the present embodiment are described. The steps shown in FIG. 15 are performed between the nodes (A) and (B) in the main routine of FIG. 11(*a*). Steps S55–S57 correspond to the case where the lamp power of the HID lamp 3 connected to the HID lamp operating device 20 is known and does not require identification by the lamp power identifier 13. The main difference from the steps shown in FIG. 11(*b*) is found in the steps S62–S77. When (V1a) = (VS2), the lamp power identifier 13 compares identifying time, i.e., the counted time (Ts) in this example, with each of the threshold values (t2) and (t3), and performs the lamp power identification as described above. Furthermore, if the relation (t2)<(Ts)<(t3) is satisfied and if the time from the start of operation (Tc)=(Ta), the lamp power identification is conducted based on identifying voltage, for example, the lamp voltage (V1a) at the time (Ta) shown in FIGS. 10 and 13 as described above. Specifically, the lamp power identifier 13 compares the voltage (Va) with the predetermined threshold voltage (Vx) (step S73). It should be noted that, according to the current embodiment, the power supplier controller 12 may control the power supplier 5 to control the current supplied to the HID lamp 3 to be substantially constant, or to control the power supplied to the HID lamp 3 to be substantially constant.

Figure 16:
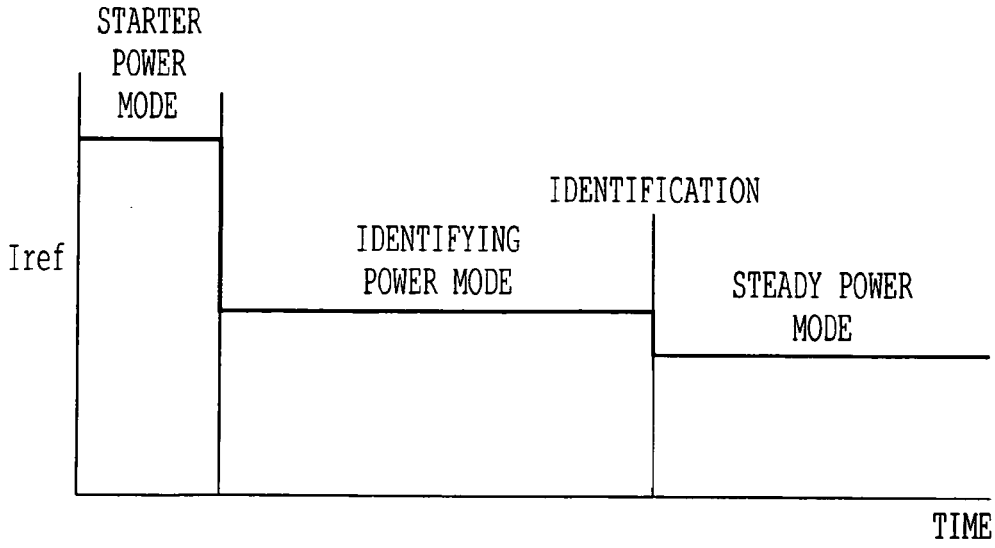
FIG. 16 is a graph showing a temporal variation in a reference lamp current in different operation modes.

A sixth embodiment of the present invention relates to the amount of current supplied to the HID lamp 3 in the starter power mode. In order to effectively drive the HID lamp 3, it is preferable to supply a current 1.5–2 times larger than the rated current of each lamp at the start of operation. In view of this preference, the power supplier controller 12 according to the present embodiment controls the power supplier 5 to supply a starter current required to drive the HID lamp 3 of the highest lamp power among the lamps of interest. FIG. 16 show the amount of current supplied to the HID lamp 3 in the starter power mode, the identifying power mode and the steady power mode. The lamp power identifier 13 first sends a signal commanding the data set selection unit 11 to select the map for the starter power mode, and the power supplier controller 10 supplies the corresponding starter current to the HID lamp 3 for about 10 seconds, for example, and then sends another signal to the data set selection unit 11 to select the map for the identifying power mode. After the lapse of a certain period of time, for example, about 20 seconds, the lamp power identifier 13 identifies the lamp power in the manner as mentioned above.

Figure 17:
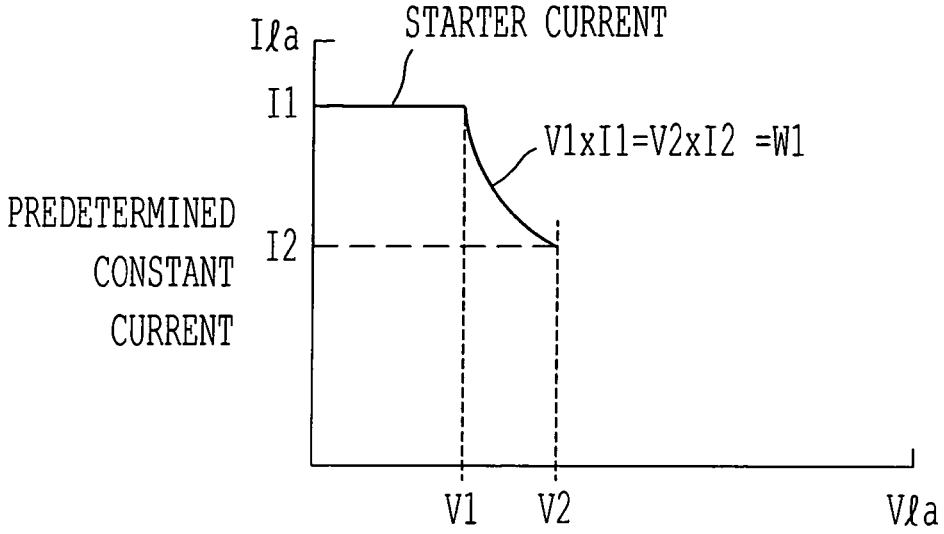
FIG. 17 is a graph showing an example of a map for a starter power mode according to a sixth embodiment.
Figure 18:
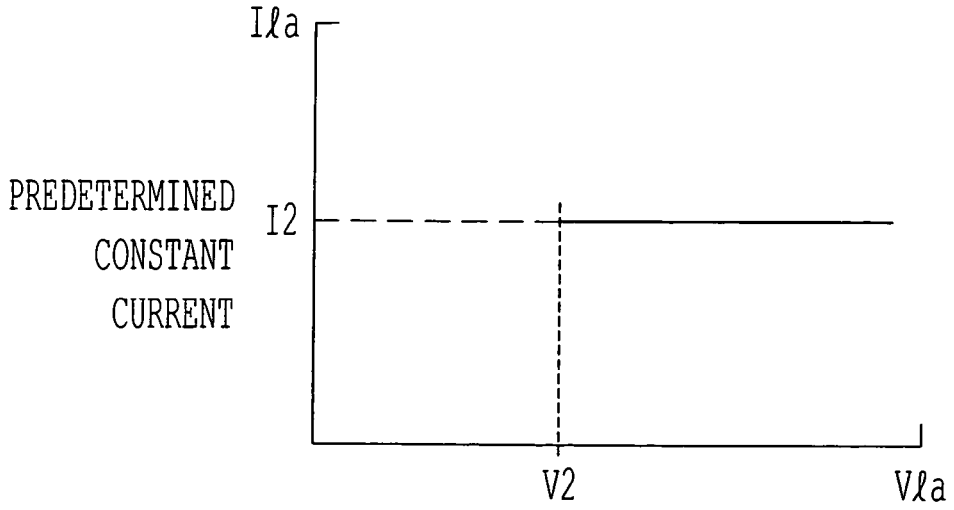
FIG. 18 is a graph showing an example of a map for an identifying power mode according to the sixth embodiment.
Figure 19:
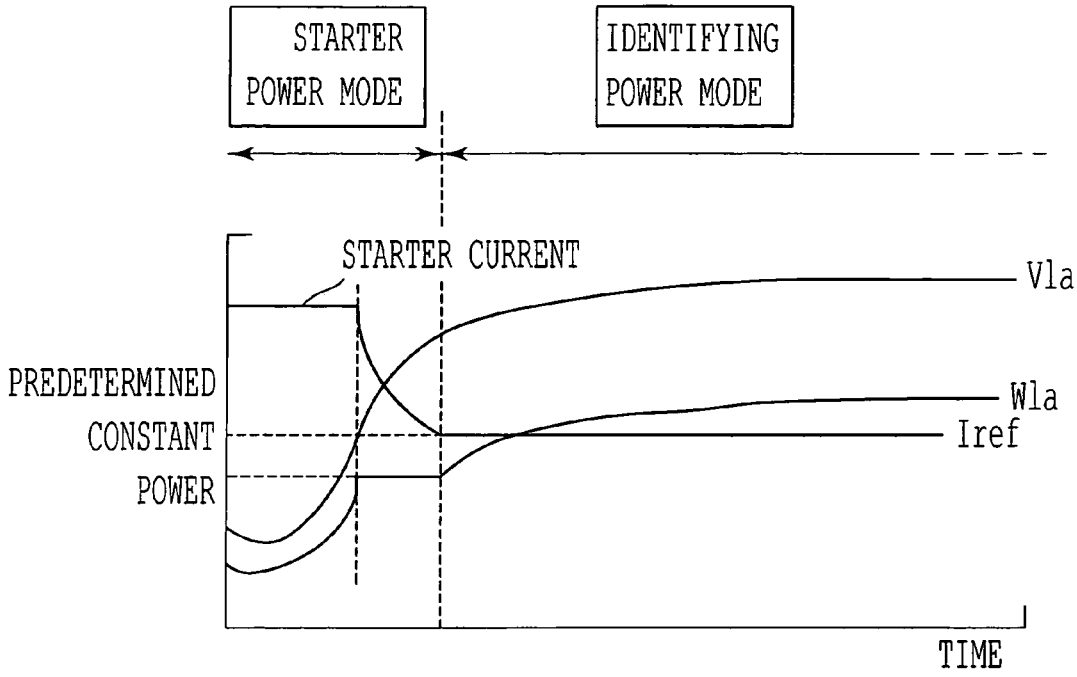
FIG. 19 is a graph showing a temporal variation in a lamp voltage (V1a), an output power (W1a) and a reference lamp current (Iref) when the power supplier controller performs the control based on the maps shown in FIGS. 17 and 18.
Figure 22:
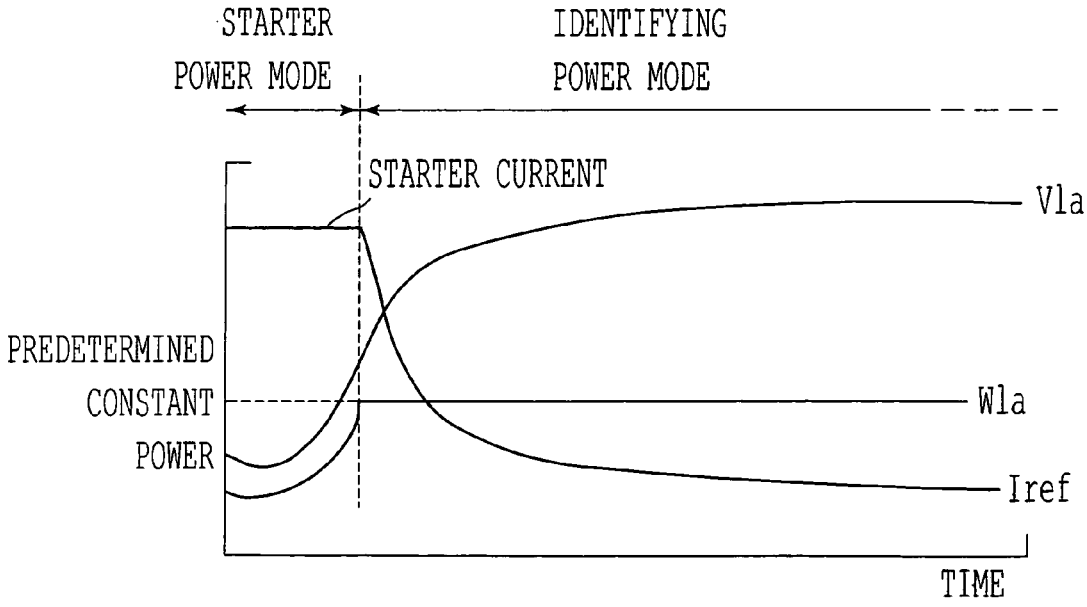
FIG. 22 is a graph showing a temporal variation in a lamp voltage (V1a), an output power (W1a) and a reference lamp current (Iref) when the power supplier controller performs the control based on the maps shown in FIGS. 20 and 21.
Figure 20:
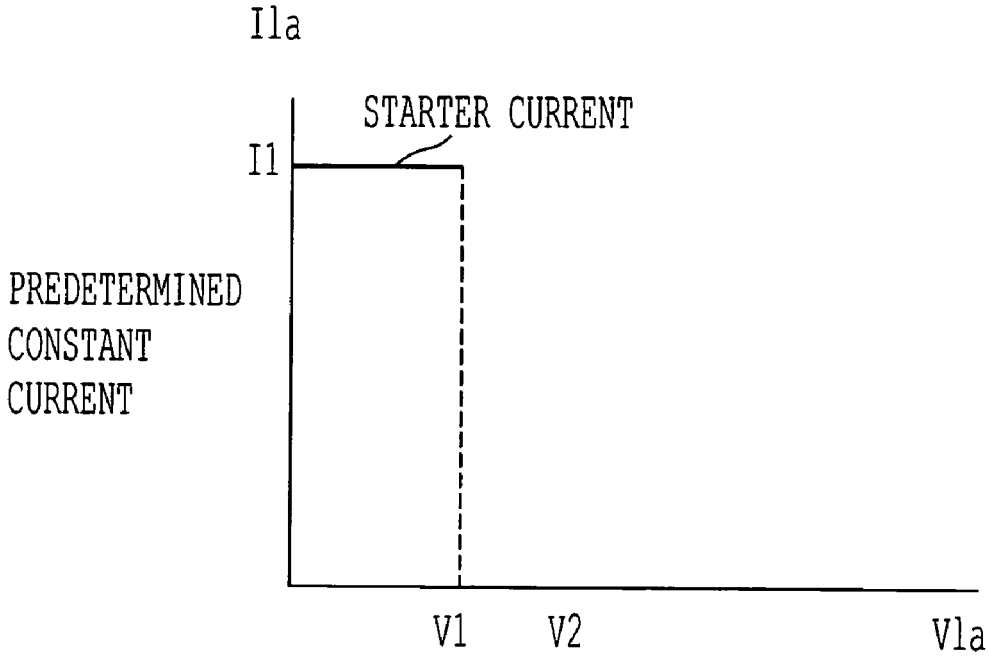
FIG. 20 is a graph showing another example of the map for the starter power mode.
Figure 21:
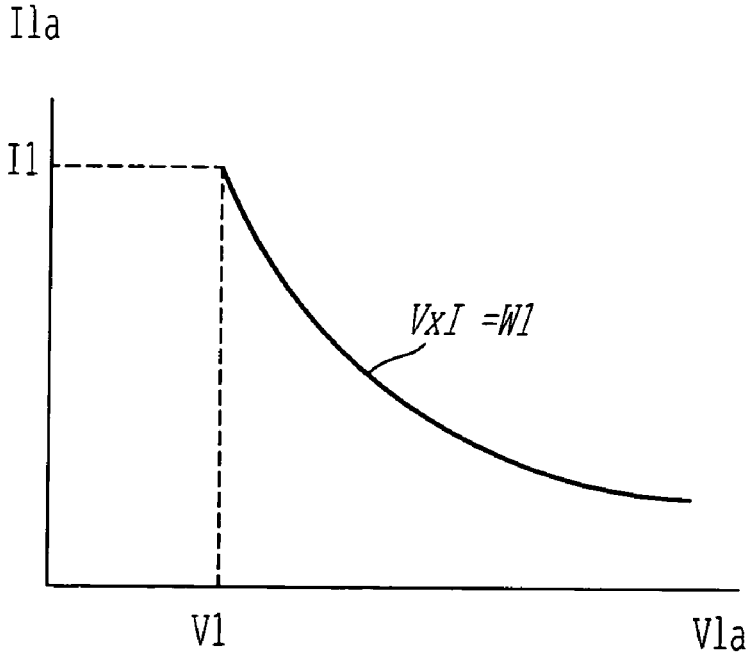
FIG. 21 is a graph showing another example of the map for the identifying power mode.
Figure 23:
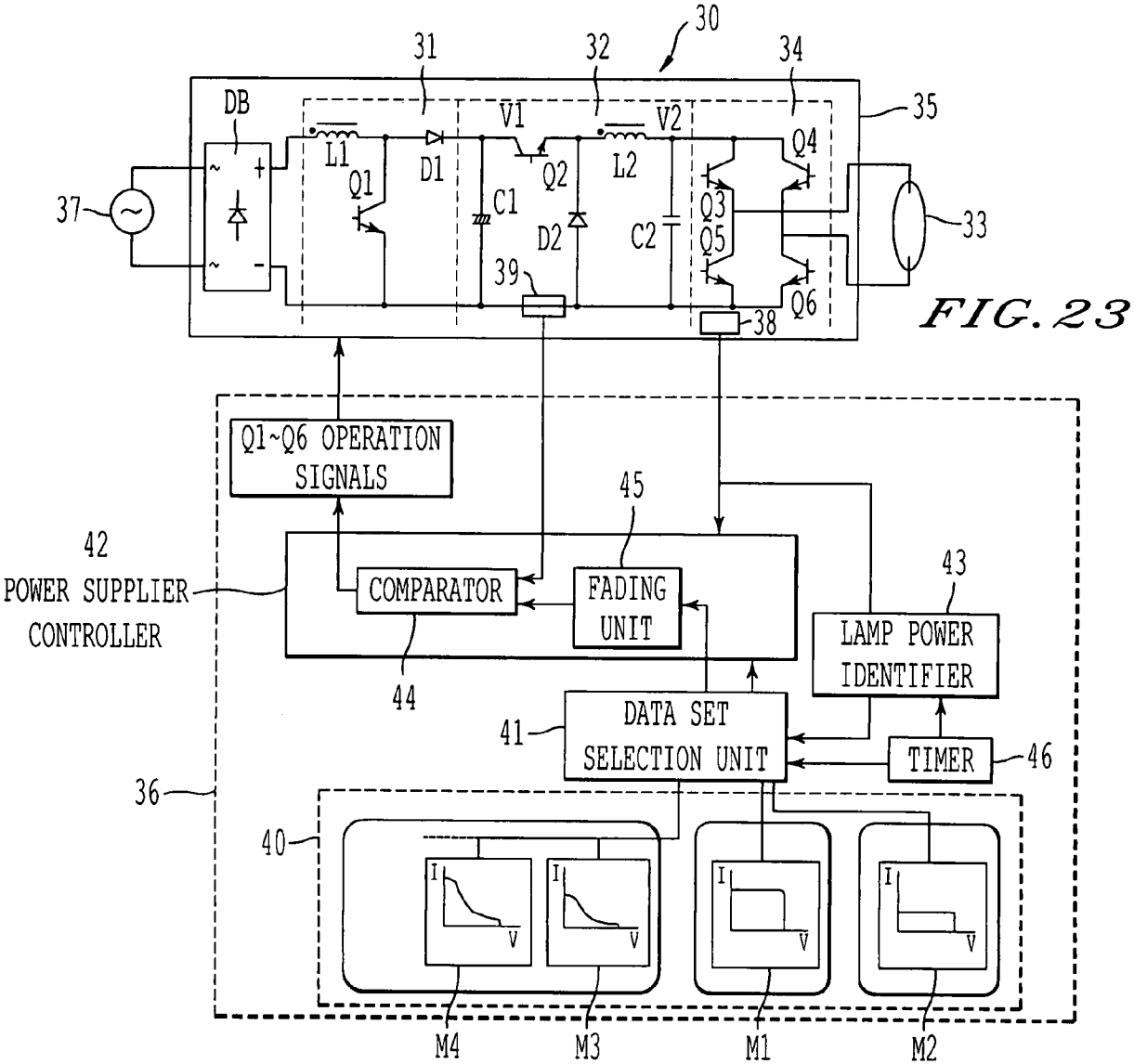
FIG. 23 is a block diagram of a high-intensity discharge lamp operating device according to a seventh embodiment.

In this embodiment, the power supplier controller 12 may control the power supplier in different manners. Two methods are described herein by referring to FIGS. 17–22. In the first method, the power supplier controller 12 follows the map of FIG. 17 in the starter power mode and the map of FIG. 18 in the identifying power mode. According to the map shown in FIG. 17, the power supplier controller 12 controls the power supplier 5 to supply a predetermined starter current (II) to the HID lamp 3 until the output power (W1a) of the HID lamp 3 reaches a predetermined value (WI). The (II) value in this example is the current required to drive the HID lamp 3 having the highest lamp power. As the lamp voltage (V1a) increases, the power supplier controller 12 decreases the current until the lamp current (I1a) reaches a predetermined current (12). Then, the data set selection unit 11 selects the map shown in FIG. 18, and the operation mode is switched to the identifying power mode. In this mode, the power supplier controller 12 regulates the current so that the lamp current (I1a) stays substantially constant at the value (I2). FIG. 19 shows the temporal variation in the lamp voltage (V1a), the output power (W1a), and the reference lamp current (Iref) in the first method described above. Alternatively, in the second method, the power supplier controller 12 performs the same control as the first method until the output power (W1a) of the HID lamp 3 reaches a predetermined value (W1). Then, the power supplier controller 12 controls the power supplier 5 to output the power substantially constant at the value (WI). FIG. 22 shows the temporal variation in the lamp voltage (V1a), the output power (W1a), and the reference lamp current (Iref) in the second method described above.

The HID lamp operating device 30 according to a seventh embodiment has the same structure as the HID lamp operating device 20 in the previous embodiments except for the control circuit 36 including a fading unit 45 configured to restrict the amount of change per unit time in the current or power output from the power supplier 35 and supplied to the HID lamp 33. Specifically, when switching from the identifying power mode to the steady power mode, the power supplier 42 regulates the current or power so that the variation per unit time does not exceed a predetermined amount. The limiting amount of the variation in the output current or output power per unit may be selected according to the purposes such as avoiding the extinction of the HID lamp 33 and reducing the color change of the HID lamp 33. For example, the power supplier controller 42 operates as follows. When the lamp current is drastically decreased, the lamp power may suddenly rise because a large amount of variation in the lamp current increases the amount of variation in the voltage as well. In order to avoid such a drastic change in the voltage, the power supplier controller 42 restricts the lamp current variation within a range such that the voltage rise does not exceed the power supply capacity of the power supplier 35. In this manner, the power supplier controller 42 avoids the lamp extinction and/or flickering out. For example, in the case where the lamp current needs to be reduced to half of the actually-detected lamp current, the variation per one second may be limited to within 10%, and the voltage may be gradually changed in more than five seconds. Also, brightness and color of the HID lamp 33 may be changed as the output power varies. In order to reduce the color change, the power supplier controller 42 restricts the variation in the lamp current so that the change in brightness or color is less noticeable. For example, in order to reduce the lamp current (I1a) to its half, the change per unit time may be limited within 1% and the lamp current may be gradually changed in more than 50 seconds.

Figure 24:
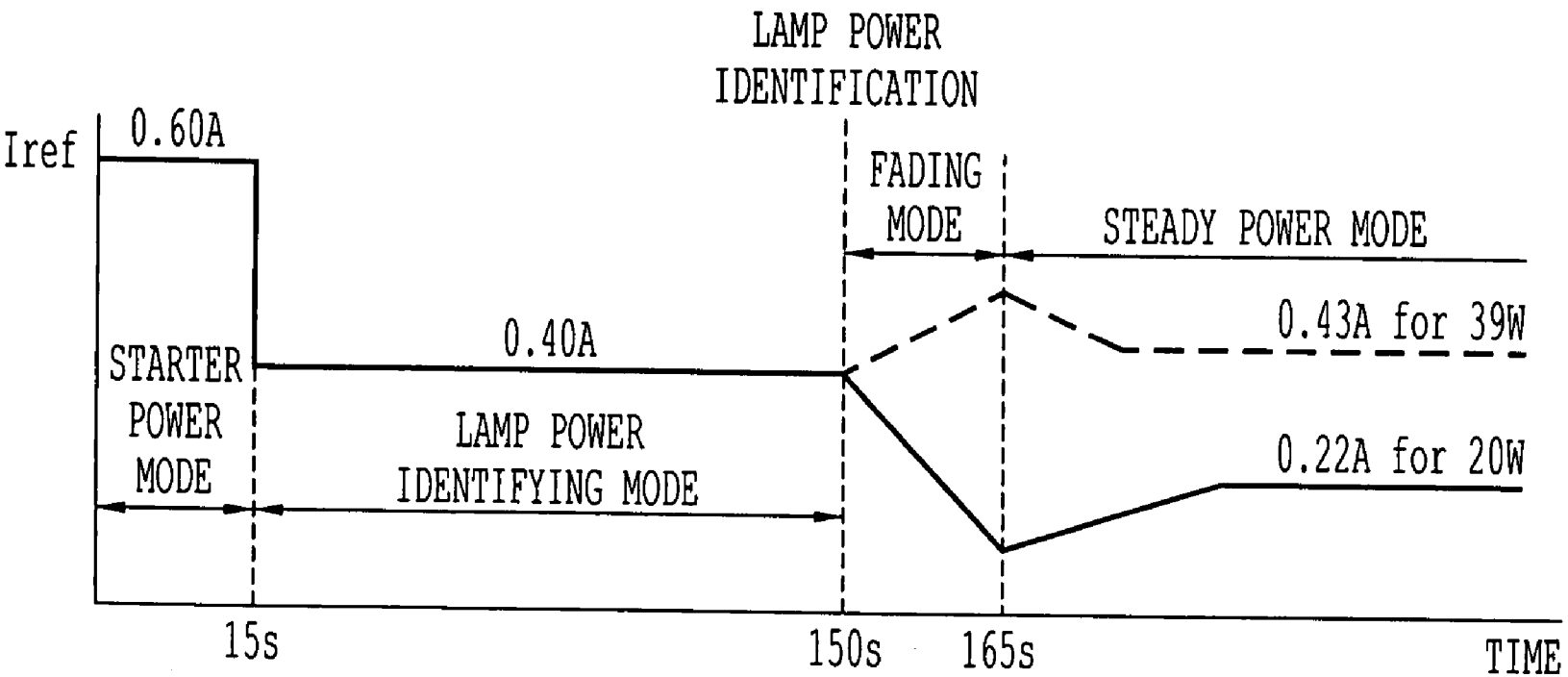
FIG. 24 is a graph showing a temporal variation in a reference lamp current (Iref) in various operation modes including a fading mode according to the seventh embodiment.

FIG. 24 shows the temporal variation in the reference lamp current (Iref). In the present embodiment, a fading mode follows the identifying power mode. During the fading mode, the reference lamp current (Iref) is continuously changed to be the lamp power of the HID lamp 33. Although the length of the fading mode is 15 seconds in this example, it is not limited to 15 seconds and may be of any length as long as the lamp extinction and flickering out are effectively avoided. In this example, the lamp power is identified at t=150. The solid line corresponds to the HID lamp 33 having a lamp power of 20 W, and the dotted line corresponds to the HID lamp 33 with a lamp power of 39 W. After the identification process, in the fade mode for 15 seconds, the reference lamp current (Iref) is gradually decreased in the case of 20 W, while the reference lamp current (Iref) is gradually increased in the case of 39 W, so that the output power of the power supplier 5 reaches the lamp power of the identified lamp power. In the case of 20 W, the lamp voltage (V1a) is greater than the rated voltage (Vrtd) and the lamp current (I1a) is smaller than the rated current. On the other hand, in the case of 20 W, the lamp voltage (V1a) is smaller than the rated voltage (Vrtd) and the lamp current (I1a) is greater than the rated current of the lamp. In the stead power mode, the lamp voltage (V1a) gradually approaches to the rated voltage, and accordingly the lamp current approaches to the rated value.

The fading unit 45 may include a controller that performs the following operations so as to limit the variance to a predetermined value (d1) if the reference lamp current (Iref) and the last reference lamp current (Iref') differ by more than (d1):

$$\text{If } (Iref)=(Iref')>d1, \text{ then } Iref \leftarrow Iref'+d1 \quad (1)$$

$$\text{If } (Iref)=(Iref')<-d1, \text{ then } Iref \leftarrow Iref'-d1 \quad (2)$$

Alternatively, the reference lamp current (Iref) may be output through a low path filter.

Figure 25A:
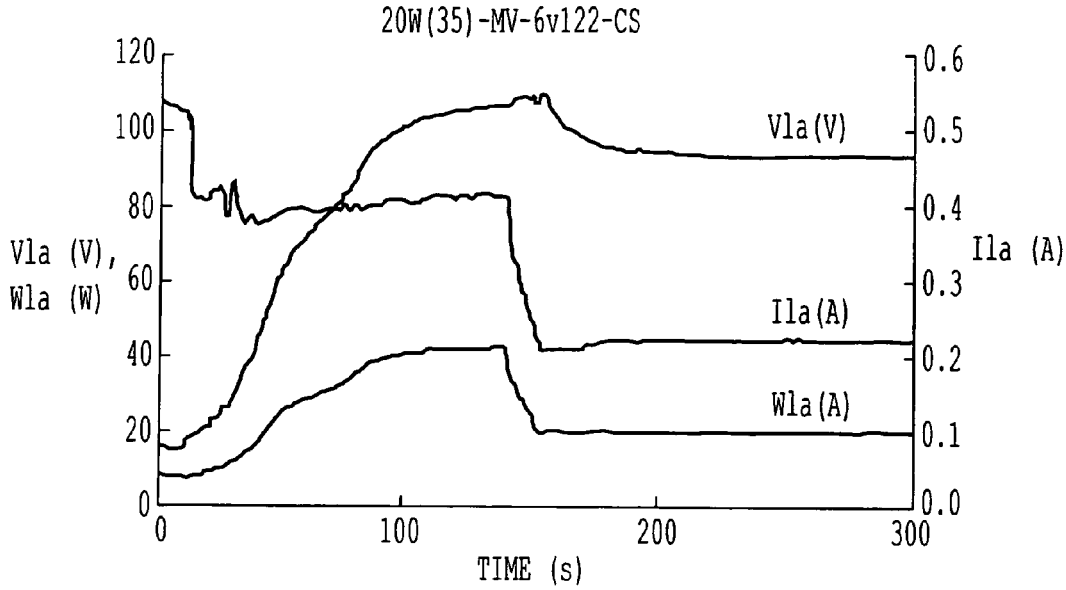
FIGS. 25(*a*) and 25(*b*) are graphs showing electric characteristics of ceramic metal halide lamps operated in the high-intensity discharge lamp according to the seventh embodiment, FIG. 25(*a*) being a measurement of a ceramic metal halide lamp having a lamp power of 20 W, and FIG. 25(*b*) being a measurement of the ceramic metal halide lamp having a lamp power of 39 W.
Figure 25B:
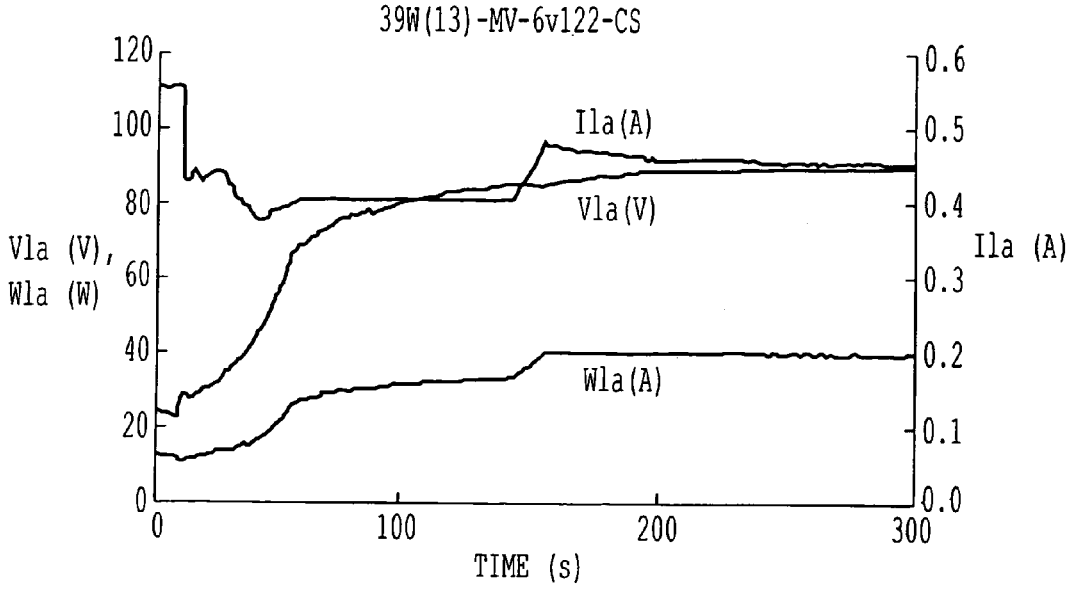

FIGS. 25(*a*) and 25(*b*) show the lamp electric characteristics, i.e., the lamp voltage (V1a), the lamp current (I1a), and the lamp power (W1a), of the ceramic metal halide lamp (manufactured by General Electric Company) having the lamp powers of 20 W and 39 W, respectively. It is clearly shown that the temporal variation in the lamp current (I1a) is substantially the same as the temporal variation in the reference lamp current (Iref) shown in FIG. 24. As described above, the HID lamp operating device 33 according to the present embodiment achieves reliable operations of HID lamps with different lamp powers within 5 minutes after the start of operation.

Figure 26:
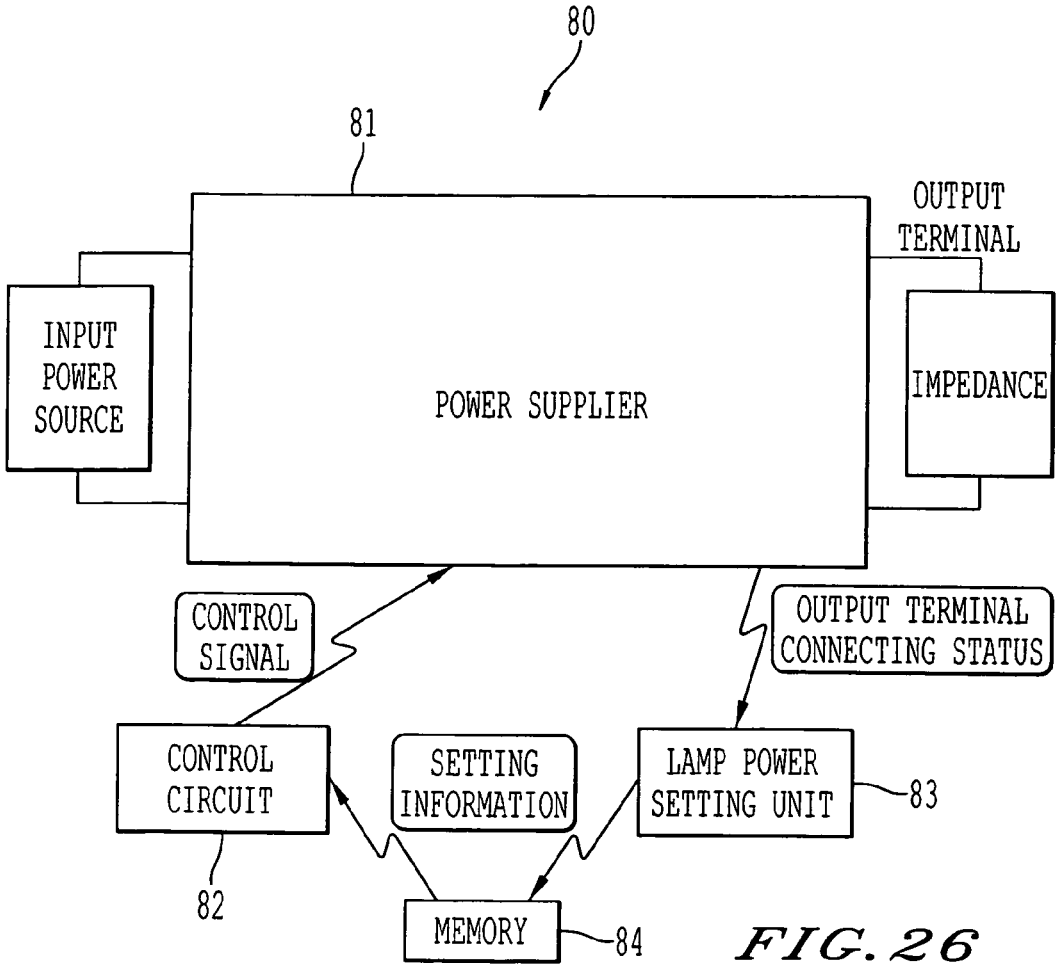
FIG. 26 is a block diagram of a high-intensity discharge lamp operating device according to an eighth embodiment.
Figure 27:
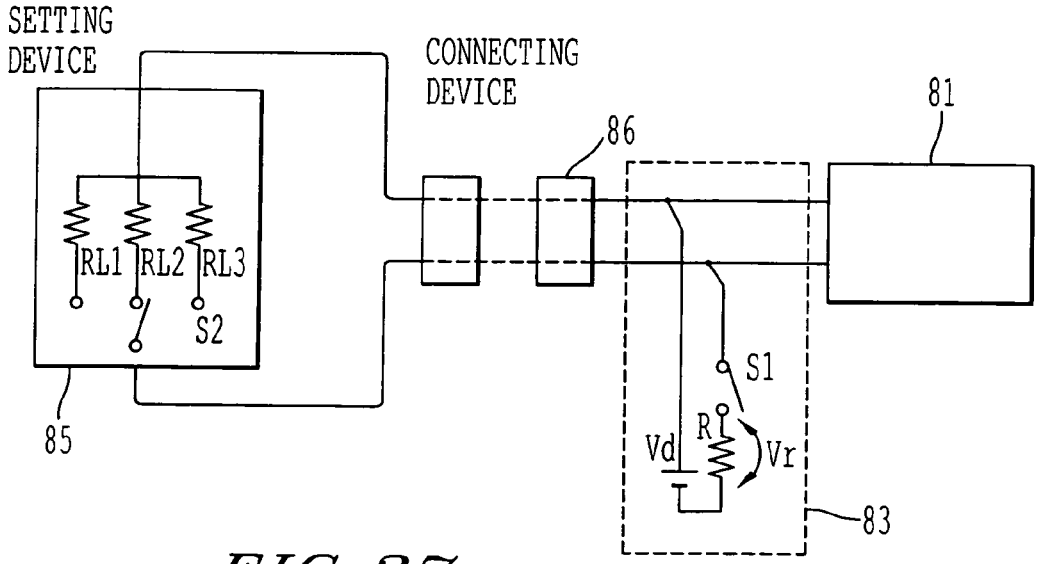
FIG. 27 is a block diagram of a lamp power setting unit and a setting device of the high-intensity discharge lamp operating device shown in FIG. 26.

FIG. 26 is a block diagram of an HID lamp operating device according to an eighth embodiment. The HID lamp operating device 80 includes a power supplier 81 connected to an input power source, a control circuit 82 connected to the power supplier 81, a lamp power setting unit 83 and a memory 84. The power supplier 81 is configured to supply power to an HID lamp connected to an output terminal of the power supplier 81. The control circuit 82 is configured to control the power output to the HID lamp so that the HID lamp is operated with its lamp power. The lamp power setting unit 83 is configured to detect the lamp power of the HID lamp and provide the value of the lamp power to the control circuit 82. As shown in FIG. 27, the lamp power setting unit 83 includes a power source (Vd), a resistance (R), and a switch (S1) connected in series. A setting device 85 is connected to the output terminal of the power supplier 81 through a connecting device 86. The connecting device 86 includes resistances (RL1)–(RL3) and a switch (S2). The lamp power setting unit 83 varies a voltage (Vr) applied across the resistance (R) while the switch (S1) is turned on, and identifies the lamp power based on the voltage (Vr). When the setting device 85 is connected to the power supplier 81 and the switch (S1) is closed, the voltage (Vr) applied across the resistance (R) is obtained by the following formula:

$$Vr=Vd*(R/(R+RL)) \quad (3)$$

As shown in FIG. 27, the switch (S2) in the setting device 85 is connected with one of the resistances (R1)–(R3), and depending on this connection, the value of the voltage (Vr) is varied. The lamp power setting unit 83 identifies the lamp power based on the (Vr) value, and then the memory 84 stores the (Vr) value as setting information.

When the HID lamp is connected to the output terminal of the power supplier 81 and before the start of operation, since the voltage (Vd) is smaller than the voltage necessary to start discharging in the HID lamp, the resistance (R) receives no current when the switch (S1) is closed, and thus the value of the voltage (Vr) becomes zero. Then, the setting unit detects the HID lamp connected to the output end, the switch (S1) is opened, and then the control circuit supplies the power suitable for the lamp power as stored in the memory.

Figure 28:
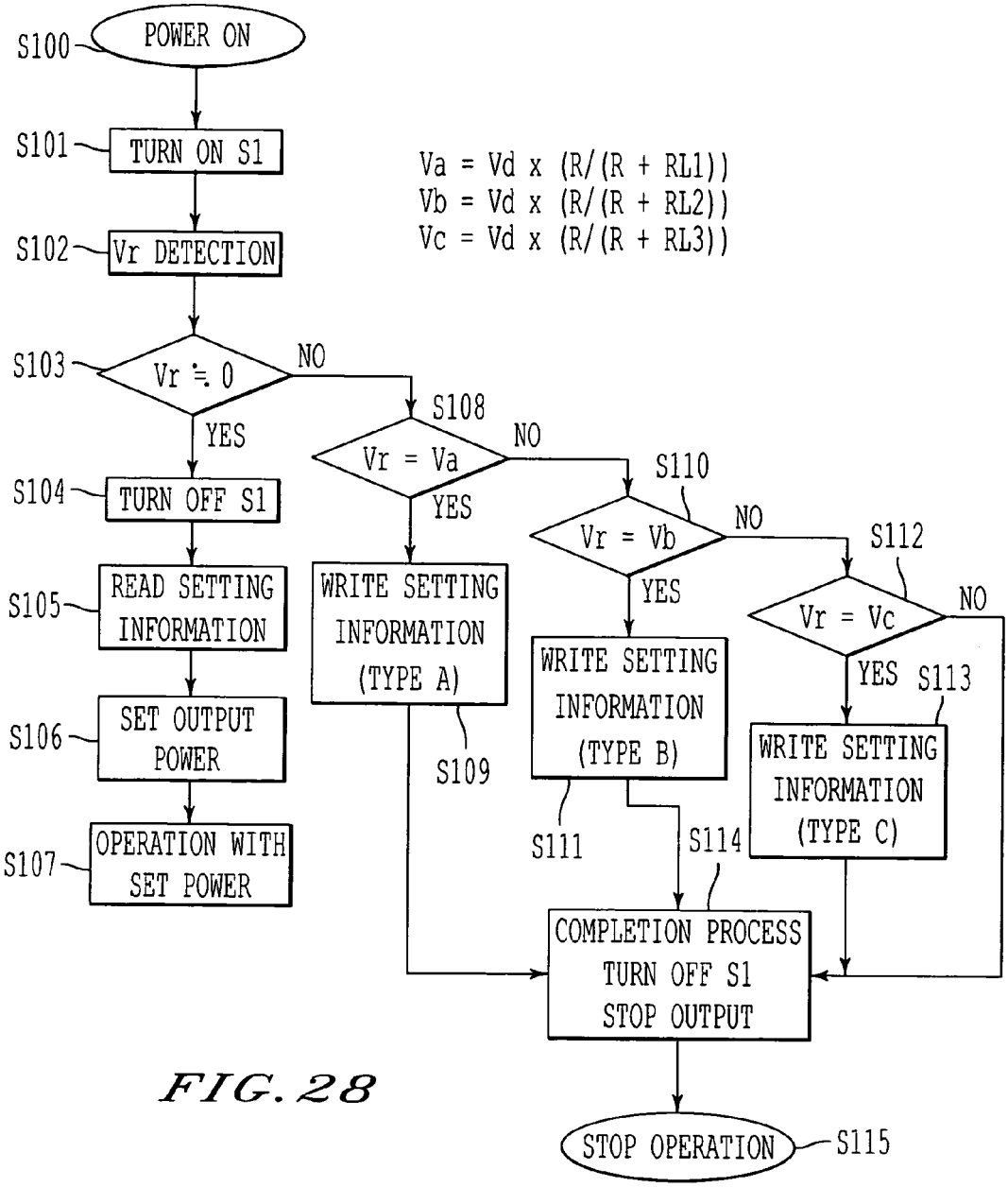
FIG. 28 is a flowchart showing operation steps of a power supplier of the high-intensity discharge lamp operating device.

Referring to FIG. 28, operation steps of the HID lamp operating device 80 are described in more details. After the HID lamp operating device 80 receives an input voltage and starts the operation (step S100), the switch (S1) is turned on to connect the power source (Vd) with the resistance (R) and the output terminal (step S101). The voltage (Vr) applied across the resistance (R) is detected (step S102), and the lamp power setting unit 83 determines whether to perform setting of the output power or to start operating the HID lamp. When the voltage (Vr)=0, the HID lamp is connected to the output terminal, and thus it is considered as an open load state. Then, the switch (S1) is turned off (step S104), and the control circuit 82 reads out the lamp power stored as the setting information in the memory 84 (step S105), sets the output power (step S106), and operates the HID lamp according to the value of the lamp power (step S107). When the voltage (Vr) is one of (Va), (Vb) and (Vc), the lamp power setting unit 83 determines that the setting device 85 is connected to the output terminal. In this example, depending on the connection at the switch (S2), the voltage (Vr) has the following values, (Va), (Vb) and (Vc):

$$Va=Vd*(R/(R+RL1)) \quad (4)$$

$$Vb=Vd*(R/(R+RL2)) \quad (5)$$

$$Vc=Vd*(R/(R+RL3)) \quad (6)$$

Specifically, (Va), (Vb) and (Vc) are the values of the voltage (Vr) when the output terminal of the power supplier 81 is connected with the impedance (RL1), (RL2) and (RL3), respectively. When the switch (S1) is closed and the detected value of (Vr) is one of (Va), (Vb) and (Vc), the memory 84 stores the value of the corresponding lamp power as the setting information (steps S108–S113). Specifically, the memory 84 stores "type (A)" when (Vr)=(Va), "type (B)" when (Vr)=(Vb), and "type (C)" when (Vr)=(Vc). Thereafter, as a completion process, the switch (S1) is turned off, the voltage supply to the output terminal is stopped, the setting of the output power is completed, and the operation is stopped (steps S114 and S115). Then, the input power source is shut down, an HID lamp is connected to the output terminal, the power source is turned on, and the HID lamp is operated with the output power based on the setting information stored in the memory 84 as described above. When the voltage (Vr) has values other than zero, (Va), (Vb), (Vc) and proximate values of these values including measurement errors, the HID lamp is not operated, and the memory 84 does not store any new setting information. The setting device 85 does not necessarily include a switch and a resistance, and may include a resistance corresponding to a desired output power. The switch (S1) and switch (S2) may include a MOSFET (metal oxide semiconductor field effect transistor) or other switches that open and close based on electric signals. The power source (Vd) may be a DC source or an AC source such as commercial source connected to the HID lamp operating device. The impedance (RL) may include an incandescent bulb or a halogen lamp. Also, the power source (Vd) may include a battery disposed in the setting unit.

According to the present embodiment, setting a lamp power of the HID lamp is easily performed in the same manner as replacing the HID lamp connected to the HID lamp operating device with another HID lamp. Thus, the HID lamp operating device according to the present embodiment saves time and labor, while conventional HID lamp operating devices requires time and effort in setting lamp powers of the HID lamps of each type, even with a switch for setting the lamp powers, because such a switch is often located in high places such as an attic or other places requiring a lot of labor.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-intensity discharge lamp operating device comprising:

a power supplier configured to supply power to a high-intensity discharge lamp connected to the power supplier;

a memory containing a starter power data set, an identifying power data set and a plurality of steady power data sets;

a detector configured to detect voltage applied to the high-intensity discharge lamp;

a power supplier controller configured to control the power supplier to control the power supplied from the power supplier to the high-intensity discharge lamp according to the starter power data set, the identifying power data set and one of the plurality of steady power data sets;

a lamp power identifier configured to identify a lamp power of the high-intensity discharge lamp based on the voltage detected by the detector while the power supplier controller controls the power according to the identifying power data set after the power supplier controller controlled the power according to the starter power data set; and a data set selection unit configured to select the one steady power data set from the plurality of steady power data sets based on the lamp power identified by the lamp power identifier, the power supplier controller being configured to control the power according to the one steady power data set after the data set selection unit selects the one steady power data set.

2. The high-intensity discharge lamp operating device according to claim 1, wherein the power supplier controller is configured to control the power supplier to control current supplied from the power supplier to the high-intensity discharge lamp to be substantially constant current while the power supplier controller controls the power supplier according to the identifying power data set.

3. The high-intensity discharge lamp operating apparatus according to claim 2, wherein the detector is configured to detect identifying voltage at a time when a predetermined time has elapsed from a time when the power supplier controller begins controlling the power supplier according to the identifying power data set, and wherein the lamp power identifier configured to identify the lamp power by comparing the identifying voltage with at least one threshold voltage.

4. The high-intensity discharge lamp operating device according to claim 2, further comprising a timer which is configured to measure identifying time during which the voltage increases from a first predetermined voltage to a second predetermined voltage, wherein the lamp power identifier is configured to identify the lamp power by comparing the identifying time with at least one threshold time.

5. The high-intensity discharge lamp operating device according to claim 2, further comprising a timer which is configured to measure identifying time during which the voltage increases from a first predetermined voltage to a second predetermined voltage, wherein the detector is configured to detect identifying voltage at a time when a predetermined time has elapsed from a time when the power supplier controller begins controlling the power supplier according to the identifying power data set, and wherein the lamp power identifier is configured to identify the lamp power by comparing the identifying time with at least two threshold time and by comparing the identifying voltage with at least one threshold voltage.

6. The high-intensity discharge lamp operating device according to claim 5, wherein the lamp power identifier includes a first identifier configured to identify the lamp power by comparing the identifying time with at least two threshold time and a second identifier configured to identify the lamp power by comparing the identifying voltage with at least one threshold voltage when the first identifier fails in an identification of the lamp power based on the identifying time.

7. The high-intensity discharge lamp operating device according to claim 6, wherein the at least two threshold time includes a first threshold time and a second threshold time shorter than the first threshold time, and the first identifier identifies the lamp power as a first type when the identifying time is not shorter than the first threshold time, identifies the lamp power as a second type when the identifying time is shorter than the second threshold time, and wherein, when the identifying time is shorter than the first threshold time and not shorter than the second threshold time, the second identifier identifies the lamp power as the first type when the identifying voltage is not greater than the at least one threshold voltage and identifies the lamp power as the second type when the identifying voltage is greater than the at least one threshold voltage.

8. The high-intensity discharge lamp operating device according to claim 2, wherein the substantially constant current is between rated current of a high-intensity discharge lamp having lowest rated power and rated current of a high-intensity discharge lamp having highest rated power.

9. The high-intensity discharge lamp operating device according to claim 1, wherein the power supplier controller is configured to control the power supplier to control the power supplied from the power supplier to the high-intensity discharge lamp to be substantially constant power while the power supplier controller controls the power supplier according to the identifying power data set.

10. The high-intensity discharge lamp operating device according to claim 9, wherein the detector is configured to detect identifying voltage at a time when a predetermined time has elapsed from a time when the power supplier controller begins controlling the power supplier according to the identifying power data set, and wherein the lamp power identifier configured to identify the lamp power by comparing the identifying voltage with at least one threshold voltage.

11. The high-intensity discharge lamp operating device according to claim 9, further comprising a timer which is configured to measure identifying time during which the voltage increases from a first predetermined voltage to a second predetermined voltage, wherein the lamp power identifier is configured to identify the lamp power by comparing the identifying time with at least one threshold time.

12. The high-intensity discharge lamp operating device according to claim 9, further comprising a timer which is configured to measure identifying time during which the voltage increases from a first predetermined voltage to a second predetermined voltage, wherein the detector is configured to detect identifying voltage at a time when a predetermined time has elapsed from a time when the power supplier controller begins controlling the power supplier according to the identifying power data set, and wherein the lamp power identifier is configured to identify the lamp power by comparing the identifying time with at least two threshold time and by comparing the identifying voltage with at least one threshold voltage.

13. The high-intensity discharge lamp operating device according to claim 12, wherein the lamp power identifier includes a first identifier configured to identify the lamp power by comparing the identifying time with at least two threshold time and a second identifier configured to identify the lamp power by comparing the identifying voltage with at least one threshold voltage when the first identifier fails in an identification of the lamp power based on the identifying time.

14. The high-intensity discharge lamp operating device according to claim 12, wherein the at least two threshold time includes a first threshold time and a second threshold time shorter than the first threshold time, and the first identifier identifies the lamp power as a first type when the identifying time is not shorter than the first threshold time, identifies the lamp power as a second type when the identifying time is shorter than the second threshold time, and wherein, when the identifying time is shorter than the first threshold time and not shorter than the second threshold time, the second identifier identifies the lamp power as the first type when the identifying voltage is not greater than the at least one threshold voltage and identifies the lamp power as the second type when the identifying voltage is greater than the at least one threshold voltage.

15. The high-intensity discharge lamp operating device according to claim 9, wherein the substantially constant power is between rated power of a high-intensity discharge lamp having lowest rated power and rated power of a high-intensity discharge lamp having highest rated power.

16. The high-intensity discharge lamp operating device according to claim 1, wherein the power supplier controller is configured to control the power supplier to control current supplied from the power supplier to the high-intensity discharge lamp to substantially equal to a reference current determined by the voltage detected by the detector and a predetermined relationship between the voltage applied to the high-intensity discharge lamp and the reference current.

17. The high-intensity discharge lamp operating device according to claim 1, wherein the power supplier controller is configured to control the power supplier to supply current suitable for a high-intensity discharge lamp having highest rated power.

18. The high-intensity discharge lamp operating device according to claim 1, wherein the data set selection unit is configured to change a data set from the starter power data set to the identifying power data set at a time when a predetermined time has elapsed from a time when the power supplier controller begins controlling the power supplier according to the starter power data set.

19. The high-intensity discharge lamp operating device according to claim 1, wherein the data set selection unit is configured to change from the starter power data set to the identifying power data set at a time when the voltage is higher than a predetermined reference voltage.

20. The high-intensity discharge lamp operating device according to claim 1, wherein the power supplier controller includes a fading unit configured to control an amount of change per unit time in current or power supplied to the high-intensity discharge lamp to be lower than a predetermined value, when the data set selection unit changes from the identifying power data set to the one steady power data set, and the power supplier controller controls the power supplier to change the current or power supplied to the high-intensity discharge lamp.

21. The high-intensity discharge lamp operating device comprising:

power supplying means for supplying power to a high-intensity discharge lamp;

memory means for containing a starter power data set, an identifying power data set and a plurality of steady power data sets;

detection means for detecting voltage applied to the high-intensity discharge lamp;

power supplier controlling means for controlling the power supplying means to control the power supplied from the power supplying means to the high-intensity discharge lamp according to the starter power data set, the identifying power data set and one of the plurality of steady power data sets;

lamp power identifying means for identifying a lamp power of the high-intensity discharge lamp based on the voltage detected by the detection means while the power supplier controlling means controls the power according to the identifying power data set after the power supplier controlling means controlled the power according to the starter power data set; and data set selection means for selecting the one steady power data set from the plurality of steady power data sets based on the lamp power identified by the lamp power identifying means, the power supplier controlling means being configured to control the power according to the one steady power data set after the data set selection means selects the one steady power data set.

22. A controlling device for a high-intensity discharge lamp, comprising:

a memory containing a starter power data set, an identifying power data set and a plurality of steady power data sets;

a power supplier controller configured to control power supplied from a power supplier to the high-intensity discharge lamp according to the starter power data set, the identifying power data set and one of the plurality of steady power data sets;

a lamp power identifier configured to identify a lamp power of the high-intensity discharge lamp based on voltage applied to the high-intensity discharge lamp while the power supplier controller controls the power according to the identifying power data set after the power supplier controller controlled the power according to the starter power data set; and a data set selection unit configured to select the one steady power data set from the plurality of steady power data sets based on the lamp power identified by the lamp power identifier, the power supplier controller being configured to control the power according to the one steady power data set after the data set selection unit selects the one steady power data set.

23. A method for controlling a high-intensity discharge lamp, comprising:

providing a starter power data set, an identifying power data set and a plurality of steady power data sets;

controlling power supplied from a power supplier to the high-intensity discharge lamp according to the starter power data set, the identifying power data set and one of the plurality of steady power data sets;

identifying a lamp power of the high-intensity discharge lamp based on voltage applied to the high-intensity discharge lamp while the power is controlled according to the identifying power data set after power is controlled according to the starter power data set;

selecting the one steady power data set from the plurality of steady power data sets based on the identified lamp power; and the power is controlled according to the one steady power data set after the one steady power data set is selected.

* * * * *